United States Patent [19]

Kawamura et al.

[11] Patent Number: 4,977,050

[45] Date of Patent: Dec. 11, 1990

[54] ELECTROPHOTOGRAPHIC SENSITIVE MEMBER

[75] Inventors: Takao Kawamura, Sakai; Naooki Miyamoto, Yohkaichi; Hiroshi Ito, Yohkaichi; Hitoshi Takemura, Yohkaichi; Kokichi Ishibutsu, Yohkaichi, all of Japan

[73] Assignee: Kyocera Corporation, Kyoto, Japan

[21] Appl. No.: 288,949

[22] Filed: Dec. 21, 1988

[30] Foreign Application Priority Data

| | | | |
|---|---|---|---|
| Dec. 28, 1987 | [JP] | Japan | 62-333569 |
| Dec. 28, 1987 | [JP] | Japan | 62-333570 |
| Dec. 28, 1987 | [JP] | Japan | 62-333571 |
| Jan. 28, 1988 | [JP] | Japan | 63-18180 |
| May 17, 1988 | [JP] | Japan | 63-120365 |
| May 23, 1988 | [JP] | Japan | 63-125424 |
| May 30, 1988 | [JP] | Japan | 63-133792 |
| May 31, 1988 | [JP] | Japan | 63-133791 |

[51] Int. Cl.[5] ..... G03G 5/082; G03G 5/14

[52] U.S. Cl. ..... 430/57; 430/66

[58] Field of Search ..... 430/57, 66

[56] References Cited

U.S. PATENT DOCUMENTS

| | | | |
|---|---|---|---|
| 4,465,750 | 8/1984 | Ogawa et al. | 430/57 |
| 4,483,911 | 11/1984 | Ogawa et al. | 430/65 |
| 4,582,769 | 4/1986 | Kido et al. | 430/57 |
| 4,642,279 | 2/1987 | Tanigami et al. | 430/66 |
| 4,818,652 | 4/1989 | Shirai et al. | 430/57 |

FOREIGN PATENT DOCUMENTS

| | | | |
|---|---|---|---|
| 63-121057 | 5/1988 | Japan | 430/57 |
| 63-135952 | 6/1988 | Japan | 430/57 |

*Primary Examiner*—Roland E. Martin

*Attorney, Agent, or Firm*—Spensley Horn Jubas & Lubitz

[57] ABSTRACT

The present invention relates to an electrophotographic sensitive member, in particular to an electrophotographic sensitive member capable of enhancing a photosensitivity on both a short wavelength side and a long wavelength side and a charge acceptance and thus suitable for a plain paper copying machine (PPC).

The stabilized operation characteristics and durability have been required for an electrophotographic sensitive member drum carried on instruments such as high-speed copying machine and laser beam printer.

Amorphous silicon has been watched with interest for this requirement in view of superior abrasion resistance, heat resistance, antipollution property, photosensitivity characteristic and the like.

However, such the amorphous silicon photosensitive member shows the higher photosensitivity on the long wavelength side. Accordingly, in the case where this photosensitive member is carried on the plain paper copying machine with a white light, such as halogen lamp, as a light source, a problem occurs in that it is inferior in reproducibility for a wavelength zone near to red color.

It is an object of the present invention to provide an electrophotographic sensitive member capable of solving such the problem, in particular an electrophotographic sensitive member capable of enhancing the photosensitivity on both the long wave-length side and the short wavelength side and the charge acceptance by forming a photoconductive a-Si layer and a photoconductive a-Sic layer in layers and setting an atomic ratio of carbon and a thickness of the a-SiC layer as well as a content of elements of the group IIIa and/or the group Va in the periodic table in the a-SiC layer within the respective appointed ranges, whereby exhibiting the superior photosensitivity without using an infrared wavelength light-cutting filter and thus being suitable for the plain paper copying machine.

4 Claims, 24 Drawing Sheets

ELECTROPHOTOGRAPHIC SENSITIVE MEMBER

BACKGROUND OF THE INVENTION

The present invention relates to an electrophotographic sensitive member capable of enhancing a photosensitivity on both a short wavelength side and a long wavelength side and a charge acceptance and thus suitable for a plain paper copying machine.

Recently, the stabilized operation characteristics and durability have been required for an electrophotographic sensitive member carried on the instruments, such as high-speed copying machine and laser beam printer, with an active development of said instruments. Amorphous silicon has been watched with interest for this requirement in view of superior abrasion resistance, heat resistance, antipollution property, photosensitive characteristic and the like thereof.

A multi-layer type photosensitive member as shown in FIG. 1 has been proposed for an electrophotographic sensitive member formed of amorphous silicon (hereinafter called a-Si for short).

That is to say, referring to FIG. 1, a barrier layer (2), an a-Si carrier-generating layer (3) and a surface protective layer (4) are formed on an electrically conductive substrate (1) formed of aluminum and the like in this order, the barrier layer (2) being formed for preventing the carriers from entering from the substrate (1) and lowering the residual potential, and the surface protective layer (4) being formed of highly hard materials to enhance the durability of the photosensitive member.

However, such the a-Si photosensitive member exhibits the higher photosensitivity on the long wavelength side. Accordingly, in the case where this photosensitive member is carried on the plain paper copying machine (hereinafter called PPC for short) with a white color, such as halogen lamp, as a light source, it is inferior in reproducibility for a wavelength zone near to red color. In order to solve such the problem, a filter is used to cut infrared wavelength lights but this leads to the reduction of the intensity of a light, which is incident upon the photosensitive member, and as a result, the photosensitivity of the photosensitive member itself is apparently lowered.

In addition, the high charge acceptance is one of the desired characteristics required for the a-Si photosensitive member in addition to the above described photosensitivity. In the event that such the desired characteristics were achieved, a high image concentration Is obtained and the degree of freedom in the design of the developing system of the copying machine, whereby obtaining an easily usable electrophotographic sensitive member.

SUMMARY OF THE INVENTOR

Thus it is an object of the present invention to provide an electrophotographic sensitive member capable of enhancing a photosensitivity on both a short wavelength side and a long wavelength side.

It is another object of the present invention to provide an electrophotographic sensitive member capable of exhibiting a high charge acceptance.

It is a further object of the present invention to provide an electrophotographic sensitive member suitable for using in PPC.

A first invention of the present invention provides an electrophotographic sensitive member comprising at least a photoconductive a-Si layer and a photoconductive amorphous silicon carbide layer (hereinafter called a-SiC layer for short) formed on an electrically conductive substrate, characterized by that an atomic ratio of a silicon (Si) element to a carbon (C) element in said a-SiC layer is set within a range of $0.01 \leqq x \leqq 0.5$ in a value of x in $Si_{(1-x)}C_x$ and a thickness of said a-SiC layer is set within a range of 0.05 to 5 μm and in addition elements of the group IIIa in the periodic table (hereinafter called IIIa group elements) or elements of the group Va in the periodic table (hereinafter called Va group elements for short) are contained in said a-SiC layer in a quantity of 0.5 to 100 ppm and furthermore a content of these IIIa group elements or Va group elements is gradually reduced over a layer-thickness direction from said substrate to a surface of the photosensitive member.

In addition, a second invention provides an electrophotographic sensitive member comprising at least a photoconductive a-Si layer and a photoconductive a-SiC layer formed on an electrically conductive substrate in this order, characterized by that an atomic ratio of a silicon (Si) element to a carbon (C) element in said a-SiC layer is set within a range of $0.01 \leqq x \leqq 0.5$ in a value of x in $Si_{(1-x)}C_x$ and a thickness of said a-SiC layer is set within a range of 0.05 to 5 μm and in addition said a-SiC layer comprises a first layer zone containing IIIa group elements or Va group elements in a quantity of 0.5 to 100 ppm and a second layer zone Without containing IIIa group elements or Va group elements formed in layers in this order and furthermore a thickness of said second layer zone is set within a range of 0.02 to 2 μm.

Besides, a third invention provides an electrophotographic sensitive member comprising at least a photoconductive a-Si layer and a photoconductive a-SiC layer formed on an electrically conductive substrate in this order, characterized by that an atomic ratio of a silicon (Si) element to a carbon (C) element in said a-SiC layer is set within a range of $0.01 \leqq x \leqq 0.5$ in a value of x in $Si_{(1-x)}C_x$ and a thickness of said a-SiC layer is set within a range of 0.05 to 5 μm and in addition said a-SiC layer comprises a first layer zone containing IIIa group elements in a quantity of 0.5 to 100 ppm and a second layer zone containing Va group elements in a quantity of 0.5 to 100 ppm formed thereon in this order and furthermore a thickness of said second layer zone is set within a range of 0.02 to 2 μm.

Furthermore, a fourth invention provides an electrophotographic sensitive member comprising at least a photoconductive a-Si layer and a photoconductive a-SiC layer formed on an electrically conductive substrate in this order, characterized by that an atomic ratio of a silicon (Si) element to a carbon (C) element in said a-SiC layer is set within a range of $0.01 \leqq x \leqq 0.5$ in a value of x in $Si_{(1-x)}C_x$ and a thickness of said a-SiC layer is set within a range of 0.05 to 5 μm and in addition said a-SiC layer comprises a first layer zone containing Va group elements in a quantity of 0.5 to 100 ppm and a second layer zone containing IIIa group elements in a quantity of 0.5 to 100 ppm formed in layers in this order and furthermore a thickness of said second layer zone is set within a range of 0.02 to 2 μm.

DETAILED DESCRIPTION OF THE INVENTION

Figure 1:
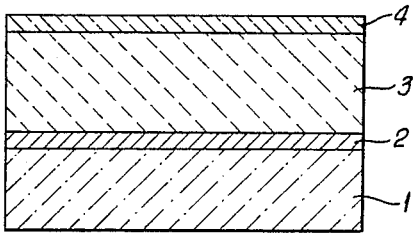
FIG. 1 is a sectional view showing a layer-structure of the conventional electrophotographic sensitive member.
Figure 2A:
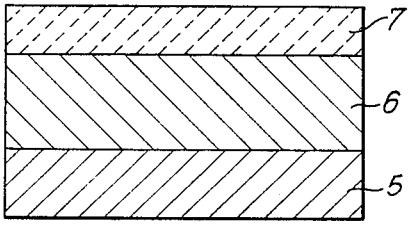
FIG. 2*a*, 2*b* is a sectional view showing a basic layer-structure of an electrophotographic sensitive member according to the present invention.
Figure 2B:
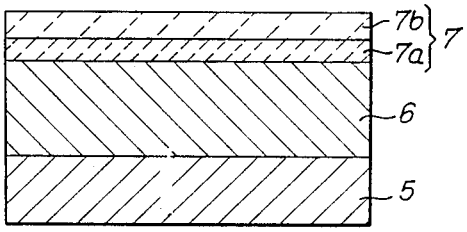

A layer-structure of the first invention, which is most basic of electrophotographic sensitive members according to the present invention, is shown in FIG. 2*a*. Referring to FIG. 2*a*, a photoconductive a-Si layer (6) and a photoconductive a-SiC layer (7) are formed on an electrically conductive substrate (5) in layers in this order and said a-SiC layer (7) comprises the above described layer zones In addition, a basic layer-structure of an electrophotographic sensitive member according to the second invention is shown in FIG. 2*b*. Referring to FIG. 2*b*, a photoelectric conductive a-Si layer (6) and a photoconductive a-SiC layer (7) are formed on an electrically conductive substrate (5) in layers in this order and said a-SiC layer (7) comprises a first layer zone (7*a*) containing llIa group elements or Va group elements and a second layer zone (7*b*) without containing them formed in layers in this order.

Also a basic layer-structure of an electrophotographic sensitive member according to the third invention and the fourth invention in the present invention is shown in FIG. 2*b* but in the third invention a photoconductive a-Si layer (6) and a photoconductive a-SiC layer (7) are formed on an electrically conductive substrate (5) in layers in this order and said a-SiC layer comprises a first layer zone (7*a*) containing IIIa group elements and a second layer zone (7*b*) containing Va group elements formed in layers in this order. Besides, in the fourth invention a photoconductive a-Si layer (6) and a photoconductive a-SiC layer (7) are formed on an electrically conductive substrate (5) in layers in this order and said a-SiC layer (7) comprises a first layer zone (7*a*) containing Va group elements and a second layer zone (7*b*) containing IIIa group elements formed in layers in this order.

The present inventors have found that in the above described construction the addition of an appointed amount of IIIa group elements or Va group elements to the above described a-SiC layer leads to a remarkable enhancement of the photosensitivity on the short wavelength side and the present invention has been achieved on the basis of this knowledge.

That is to say, the layer-structure shown in FIG. 2*a* is characterized by that if the thickness of the a-SiC layer (7) is set within the appointed range, not only the short wavelength side of the incident light is absorbed by the a-SiC layer (7) but also a light, which has transmitted through the a-SiC layer (7), that is, a light of the long wavelength side, is absorbed by the a-Si layer (6), whereby the photosensitivity of both the short wavelength side and the long wavelength side can be enhanced.

In addition, it has been found that in the case where IIIa group elements or Va group elements are added to the a-SiC layer (7) in the above described manner, the photosensitivity of the short wavelength side is enhanced while the charge acceptance has a tendency to be reduced. Accordingly, in order to solve this problem in the present invention, the first invention is characterized also by that a layer zone containing IIIa group elements or Va group elements is formed in the a-SiC layer (7) and their content is gradually reduced from the substrate to the photosensitive member in the direction of layer thickness and in addition the second to fourth inventions are characterized also by that the a-SiC layer (7) comprises at least the first laYer zone (7*a*) and the second layer zone (7*b*) to remarkably enhance the charge acceptance, as shown in FIG. 2*b*.

At first, an amorphous Si element and C element are contained as indispensable constituent elements and a hydrogen (H) element and a halogen element are contained in a quantity within an appointed range sufficient for terminating a dangling bond in the a-SiC layer (7) to give the photoelectrical conductivity. It has been found from the present inventors' experiments aiming at the confirmation of the photoelectric conductivity at various kinds of carbon content ratio that in the case where an atomic ratio of a Si element to a C element, that is, a x value of $Si_{(1-x)}C_x$ is set within a range of $0.01 \leqq x \leqq 0.5$, preferably $0.05 \leqq x \leqq 0.3$, the dark conductivity is reduced, whereby the photosensitivity on the short wavelength side can be enhanced.

It has been found also that a content of elements A, such as H element and halogen element, for terminating dangling bonds is set so that a y value of $[Si_{(1-x)}C_x]_{1-y}[A]_y$ may be within a range of $0.05 \leqq y \leqq 0.5$, preferably $0.05 \leqq y \leqq 0.4$, most preferably $0.1 \leqq y \leqq 0.3$. A H element is usually used as such the element A in view of its easy incorporation in the end portion of the dangling bond and its reduced local level density.

A thickness of such the a-SiC layer is set within a range of 0.05 to 5 μm, preferably 0.1 to 3 μm. In the case where this thickness is less than 0.05 μm, the short wavelength light is insufficiently absorbed, so that the photosensitivity can not be enhanced while in the case where it exceeds 5 μm, the residual potential is increased.

The above described atomic ratio of Si element to C element in the a-SiC layer (7), that is, said x value may be either uniform in the direction of layer thickness or changed.

In the case where the x value is changed in the direction of layer thickness, it is necessary that the thickness of the layer (7) is determined in the range of the x value of $0.01 \leqq \leqq x \leqq 0.5$ and also thus determined thickness is set within a range of 0.05 to 5 μm, preferably 0.1 to 3 μm.

The doping distribution of carbon in the case where the x value is changed in the direction of layer thickness in the above described manner is shown in for example FIGS. 4 to 9.

In the respective drawings an axis of abscissa shows the direction of layer thickness of the a-SiC layer (7), a showing a boundary surface between the a-SiC layer (7) and the a-Si layer (6), b showing an opposite boundary surface, and an axis of ordinate showing a carbon content.

In addition, the a-SiC layer (7) in FIG. 2*a* showing the construction of the first invention is formed so that IIIa group elements or Va group elements may be uniformly contained in the direction of layer thickness or their content may be gradually reduced in the direction of layer thickness. Besides, their content in the a-SiC layer is 0.5 to 100 ppm, preferably 1 to 50 ppm, in all. Furthermore, in the second invention the IIIa group elements or the Va group elements are uniformly contained in the direction of layer thickness of the first layer zone (7*a*) of said a-SiC layer (7) at 0.5 to 100 ppm, preferably 1 to 50 ppm. In addition, in the third invention the IIIa group elements are contained in the first layer zone of the a-SiC layer (7) and in the fourth invention the Va group elements are contained in said first layer zone in the above described quantity. If this content is less than 0.5 ppm, no sufficiently large photosensitivity can not be obtained while if it exceeds 100 ppm, the charge acceptance is reduced.

If the doping distribution is set in the above described manner, it is desired to set the largest content of the IIIa group elements or the Va group elements at 200 ppm or less, preferably 100 ppm or less. The setting of the content of said elements in such the range is desirable in view of the obtainment of the enchanced charge acceptance.

The above described IIIa group elements include B, Al, Ga, In and the like and the Va group elements include N, P, As, Sb, Bi and the like but of them B and P are desirable in view of superior covalent bonding property, capability of sensitively changing the semiconductor characteristics, and obtainment of superior charge acceptance and photosensitivity.

When the IIIa group elements or the Va group elements are contained in the a-SiC layer (7) in the first invention and in the first layer zone (7*a*) in the second invention, their doping distribution may be not uniform in the direction of layer thickness, as shown in for example FIGS. 10 to 27.

And, of these drawings, in FIGS. 10 to 21 an axis of abscissa shows a direction of layer thickness of the a-SiC layer (7), a being a boundary surface between the a-SiC layer (7) and the a-Si layer (6), b being an opposite boundary surface, and an axis of ordinate showing the content of the IIIa group elements or the Va group elements. In addition, in FIGS. 22 to 27 an axis of abscissa shows a direction of layer thickness of the first layer zone (7*a*) in the a-SiC layer (7), a being a boundary surface between the first layer zone (7*a*) and the a-Si layer (6), c being a boundary surface between the second layer zone (7*b*) in the a-SiC layer (7) and the a-Si layer (6), and an axis of ordinate showing a content of the IIIa group elements or the Va group elements.

In the case where the content of the IIIa group elements or the Va group elements is changed in the direction of layer thickness in the above described manner, said content is a mean value per the a-SiC layer (7) as a whole or the first layer zone (7*a*) as a whole.

In the second invention the photosensitivity on the short wavelength side could be enhanced by forming the first layer zone (7*a*) in the a-SiC layer (7) but the charge acceptance could be remarkably enhanced by additionally forming the second layer zone (7*b*). That is to say, an electric charge is accumulated on a surface of the photosensitive member by the corona charging while the carriers are induced within the photosensitive member, whereby the charge acceptance is lowered in the case where the accumulated electric charge and the induced carriers are neutralized to each other. On the contrary, the second layer zone (7*b*) exhibits a function of hindering the above described neutralization and as a result, the charge acceptance can be enhanced.

It is desired that the thickness of the above described second layer zone (7*b*) is set within a range of 0.02 to 2 μm, preferably 0.05 to 1 μm. In the case where the thickness of the second layer zone (7*b*) is less than 0.02 μm, the charge acceptance can not be enhanced while in the case where it exceeds 2 μm, the short wavelength light is absorbed by this layer zone (7*b*) to reduce the short wavelength light reaching the first layer zone (7*a*), whereby it becomes difficult to enhance the photosensitivity by this layer zone (7*a*).

Next, the third invention will be described. When the IIIa group elements are contained in the first layer zone (7*a*) in said invention, their doping distribution may be not uniform in the direction of layer thickness, as shown in FIGS. 28 to 33.

In the respective drawings an axis of abscissa shows a direction of layer thickness of the a-SiC layer (7), a being a boundary surface between the a-SiC layer (7) and the a-Si layer (6), b being an opposite boundary surface, 7*a* showing a first layer zone, 7*b* showing a second layer zone, and an axis of ordinate showing a content of the IIIa group elements In addition, in the case where the content of the IIIa group elements is changed in the direction of layer thickness, their content corresponds to a mean value per the first layer zone (7*a*) as a whole.

The photosensitivity on the short wavelength side could be enhanced by forming the first layer zone (7*a*) in the a-SiC layer (7) but the charge acceptance could be remarkably enhanced by additionally forming the second layer zone (7*b*).

It is desired that the Va group elements are uniformly contained in the second layer zone (7*b*) in the direction of layer thickness at 0.5 to 100 ppm, preferably 1 to 50 ppm. In the case where this content is less than 0.5 ppm, the charge acceptance can not be still further enhanced while in the case where it exceeds 100 ppm, the sensitivity to the short wavelength light is lowered, whereby the residual potential is increased.

The above described Va group elements include N, P, As, Sb and Bi but above all P is desirable in view of superior covalent bonding property, capability of sensitively changing the semi-conductor characteristics, and obtainment of the superior charge acceptance and photosensitivity.

When the Va group elements are contained in the second layer zone (7*b*) in the above described manner, their doping distribution may be not uniform in the direction of layer thickness, as shown in for example FIGS. 34 to 39.

In the respective drawings an axis of abscissa shows a direction of layer thickness of the a-SiC layer (7), a being a boundary surface between the a-SiC layer (7) and the a-Si layer (6), b being an opposite boundary surface, 7*a* showing a first layer zone, 7*b* showing a second layer zone, and an axis of ordinate showing a content of the Va group elements In the case where the content of the Va group elements is changed in the direction of layer thickness in the above described manner, this content corresponds to a mean value per the second layer zone (7*b*) as a whole.

It is desired that a thickness of the above described second layer zone (7*b*) is set within a range of 0.02 to 2

μm, preferably 0.05 to 1 μm. In the case where the thickness of the second layer zone (7*b*) is less than 0.02 μm, the charge acceptance can not be enhanced while in the case where it exceeds 2 μm, the short wavelength light is absorbed by this layer zone (7*b*) to reduce the short wavelength light reaching the first layer zone (7*a*), whereby it becomes to enhance the photosensitivity by this layer zone (7*a*).

In addition, in the fourth invention the IIIa group elements contained in the first layer zone (7*a*) of the a-SiC layer (7) in the above described third invention are replaced bY the Va group elements and the Va group elements contained in the second layer zone (7*b*) are replaced by the IIIa group elements, whereby the operation and effects of the fourth invention are same one as those of the third invention, so that the description of the fourth invention is omitted.

However, (IIIa) or (Va) on the axis of ordinate in FIGS. 28 to 39 is applied to the fourth invention.

In addition, said a-Si layer (6) comprises an amorphous Si element and a H element and a halogen element for terminating a dangling bond of said amorphous Si element and mainly absorbs a long wavelength light of an incident light.

It is desired that a thickness of this a-Si layer (6) is set within a range of 5 to 100 μm, preferably 10 to 50 μm. The thickness of the a-Bi layer (6) within such the range is advantageous in view of obtainment of the enhanced charge acceptance and effective absorption of the long wavelength light.

In addition, the a-Si layer (6) does not substantially contain a carbon element but a remarkably small quantity of carbon may be contained in it. In that case, if carbon is contained in a quantity within a range of 1,000 ppm or less, preferably 500 ppm or less, the photosensitivity for the long wavelength light is not remarkably lowered.

Furthermore, the IIIa group elements or the Va group elements may be contained in the a-Si layer (6) in a quantity within a range of 0.01 to 10 ppm, preferably 0.1 to 5 ppm. If they are contained in the a-Si layer (6) in a quantity within the above described range, advantages occur in that not only the enhanced charge acceptance can be obtained but also the residual potential can be reduced. Besides, the doping distribution of these IIIa group elements or the Va group elements may be either uniform or not uniform in the direction of layer thickness. In the case where they are not uniformly doped, their content is a mean value per the layer (6) as a whole.

And, the IIIa group elements contained in the a-Si layer (6) in the above described manner include B, Al, Ga, In and the like and the Va group elements include N, P, As, Sb, Bi and the like.

Thus, in the case where the electrophotographic sensitive member according to the present invention is carried on the PPC using a while light of a halogen lamp and the like as a light source, the short wavelength light is absorbed mainly by the a-SiC layer while the long wavelength light is absorbed mainly by the a-Si layer, whereby a filter for cutting an infrared wavelength light becomes unnecessary and the photosensitivity of the photosensitive member itself is remarkably enhanced, and as a result, the enhanced charge acceptance can be obtained.

The electrophotographic sensitive member according to the present invention indispensably comprises the above described two-layer structure but a barrier layer and a surface protective layer may be formed in addition to the above described two-layer structure.

Figure 3A:
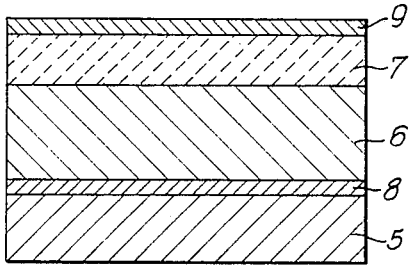
FIG. 3*a*, 3*b* is a sectional view showing a typical layer-structure of an electrophotographic sensitive member according to the present invention.
Figure 3B:
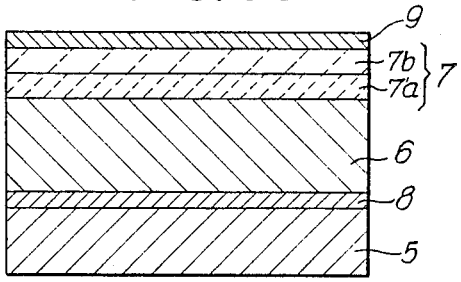
Figure 5:
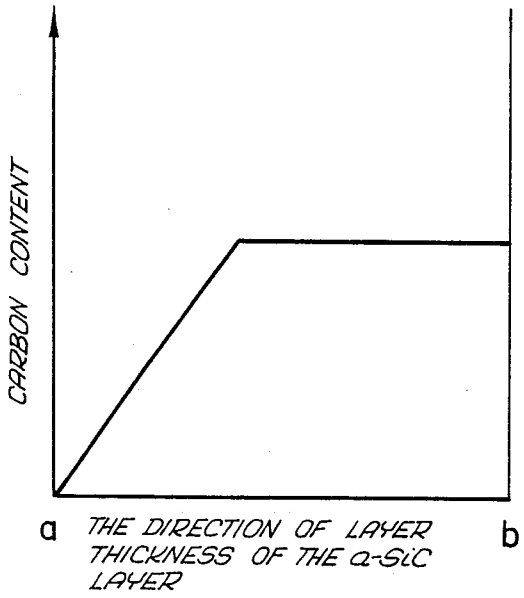
FIGS. 4 to 9 are graphs showing a doping distribution of carbon.
Figure 4:
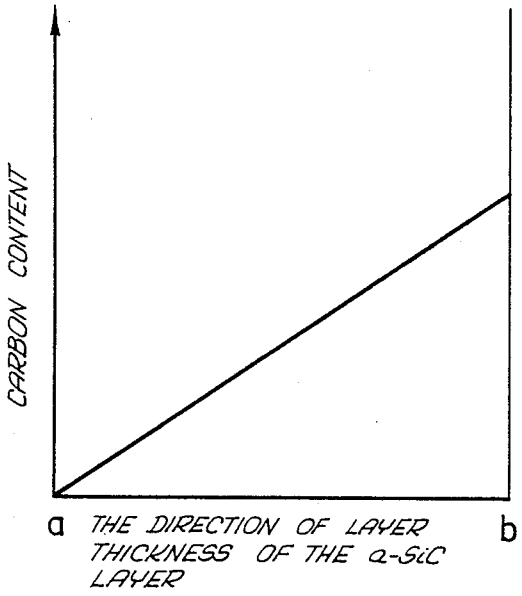
Figure 7:
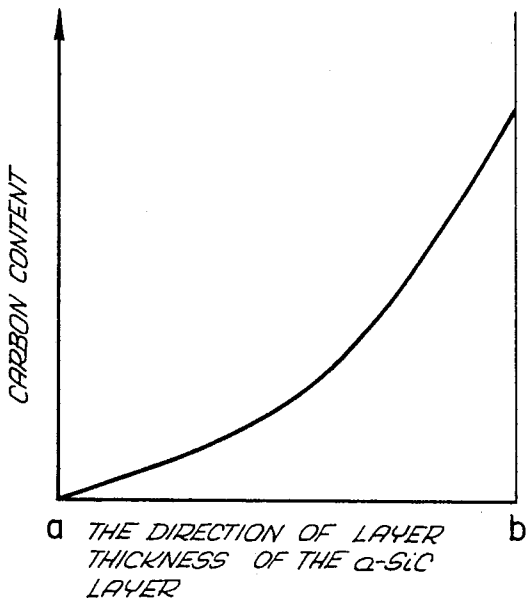
Figure 6:
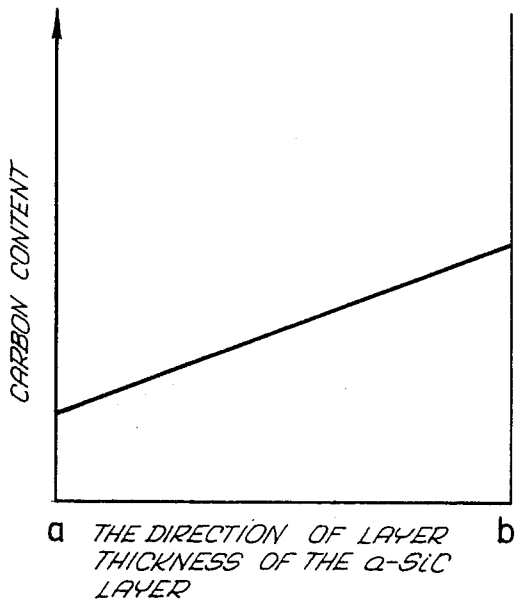
Figure 9:
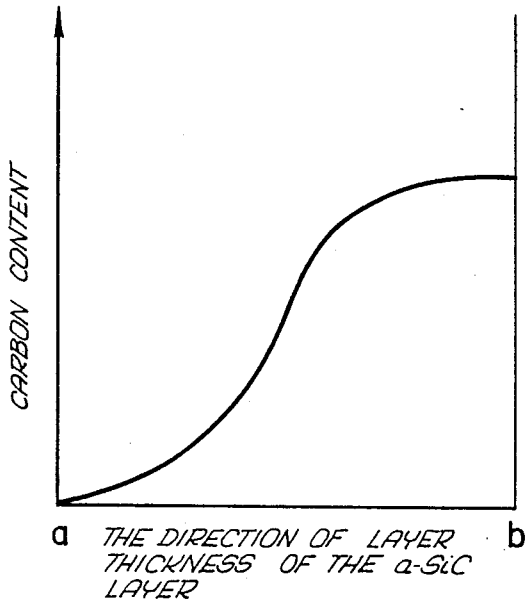
Figure 8:
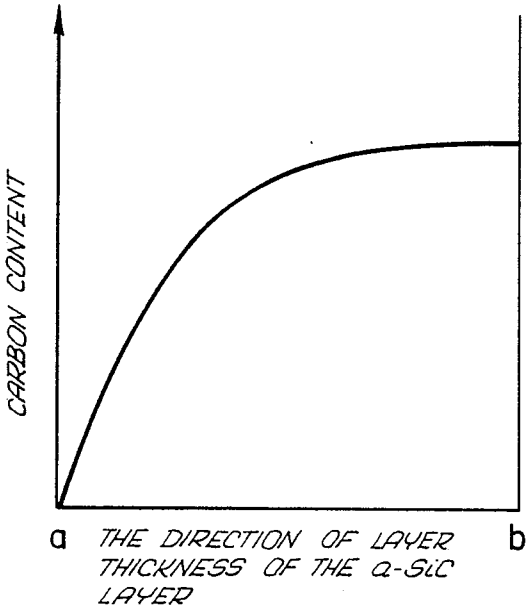
Figure 11:
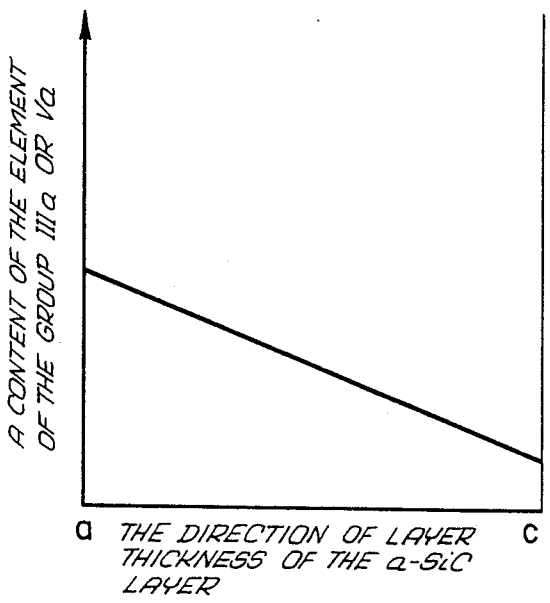
FIGS. 10 to 39 are graphs showing a doping distribution of IIIa group elements or Va group elements.
Figure 10:
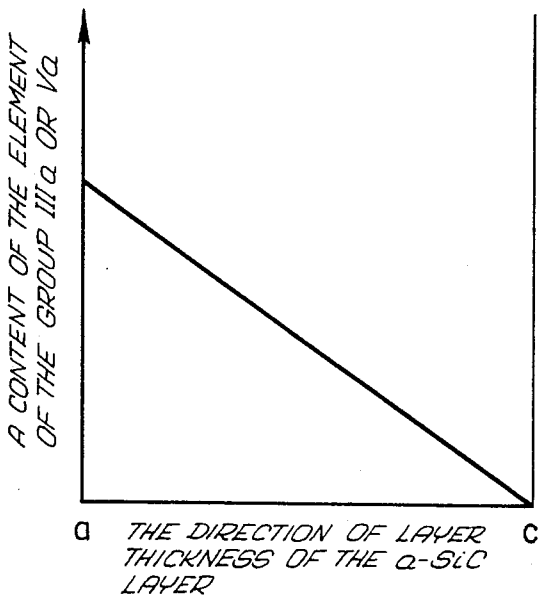
Figure 13:
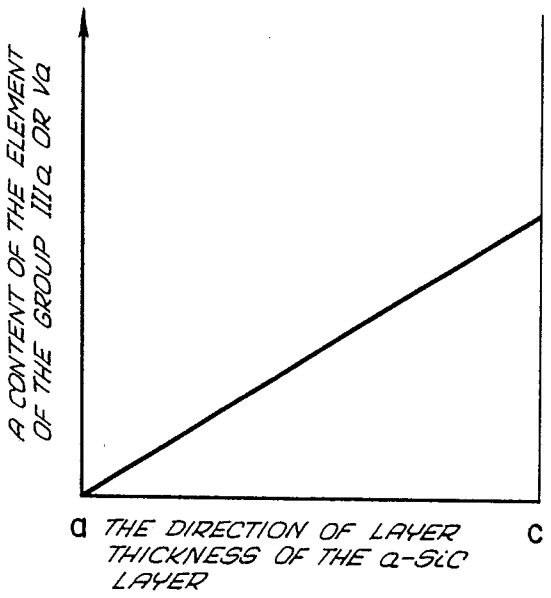
Figure 12:
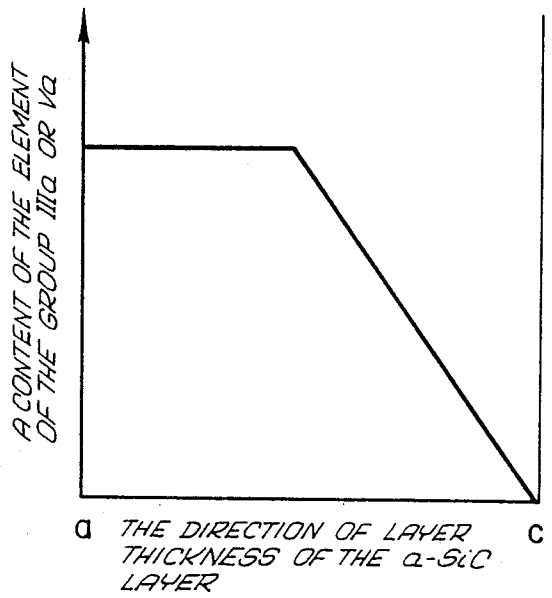
Figure 15:
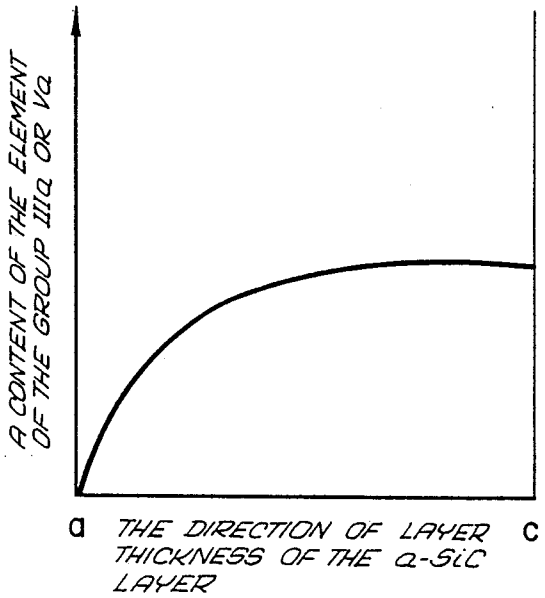
Figure 14:
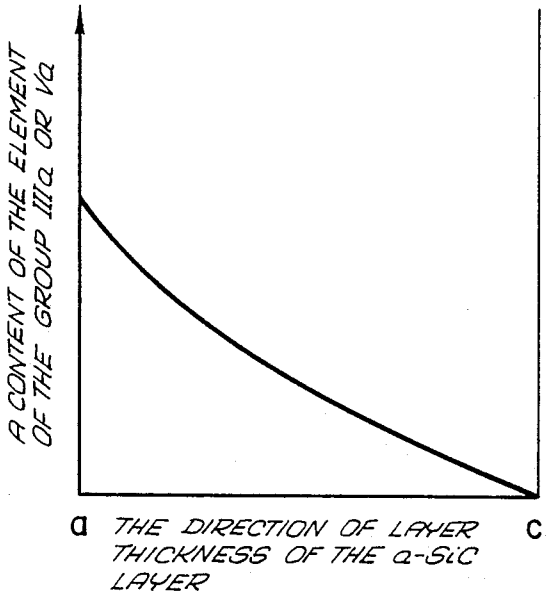
Figure 17:
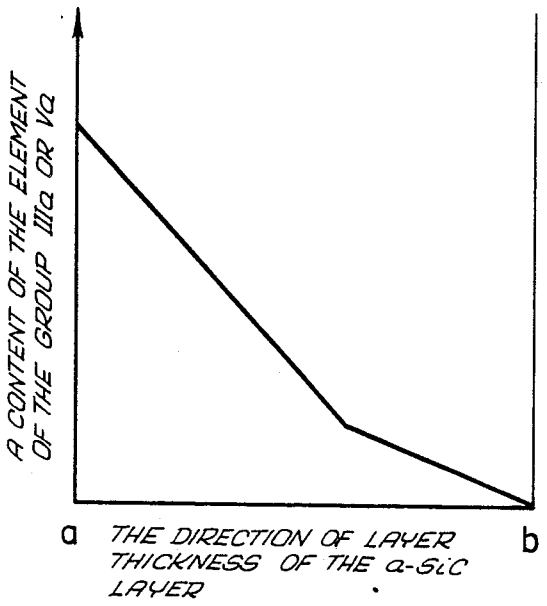
Figure 16:
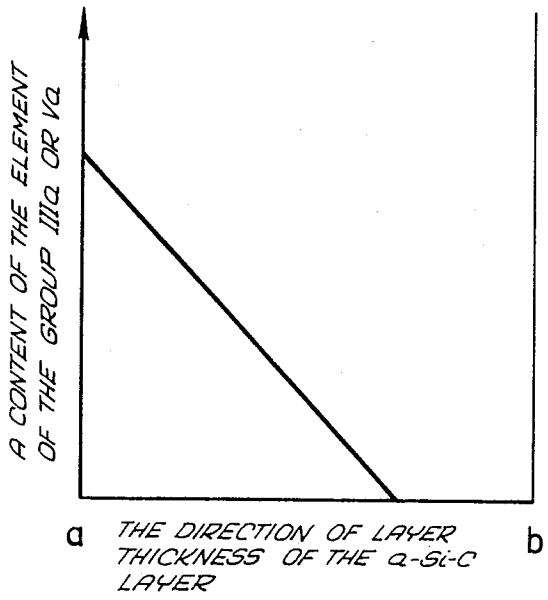
Figure 19:
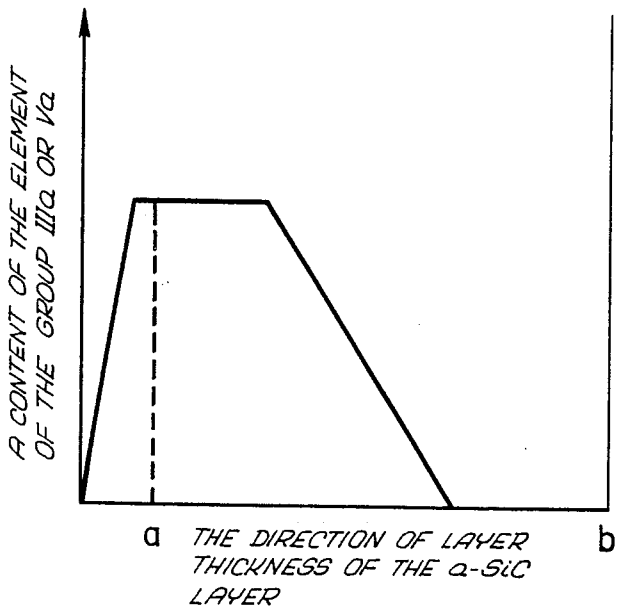
Figure 18:
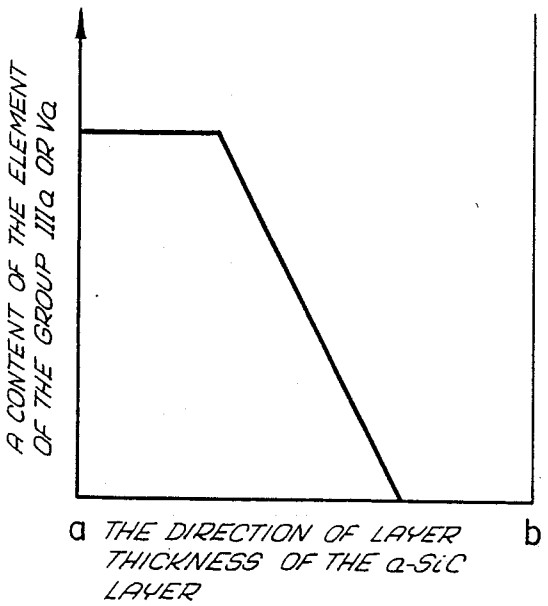
Figure 21:
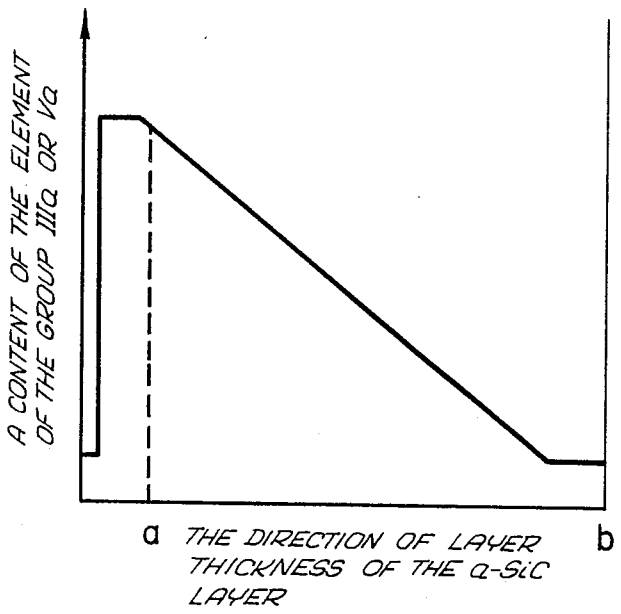
Figure 20:
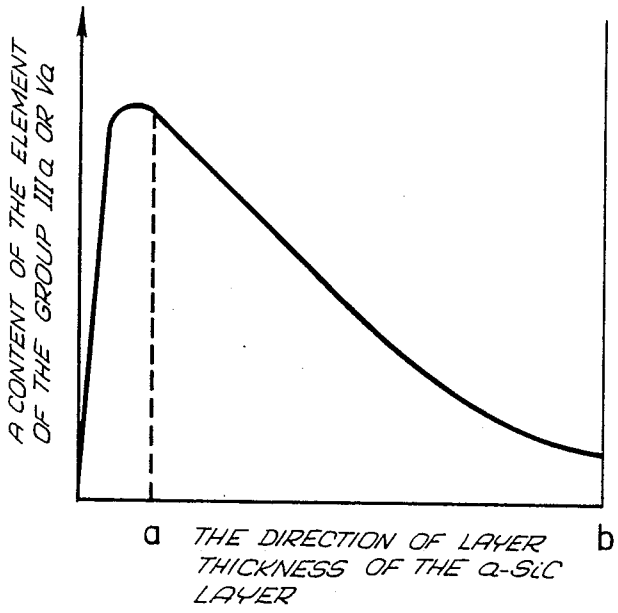
Figure 23:
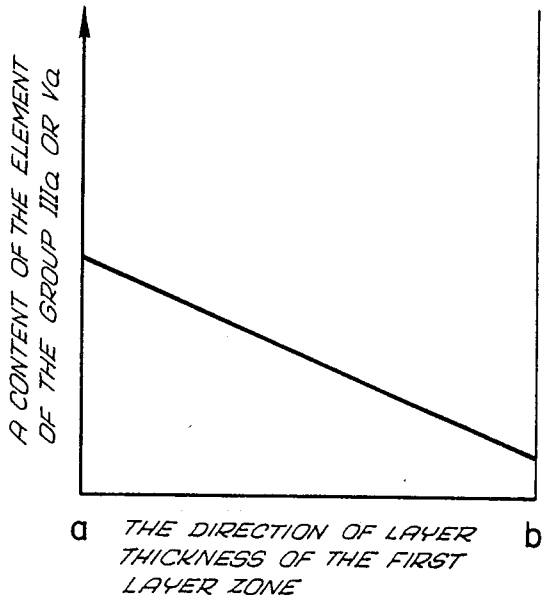
Figure 22:
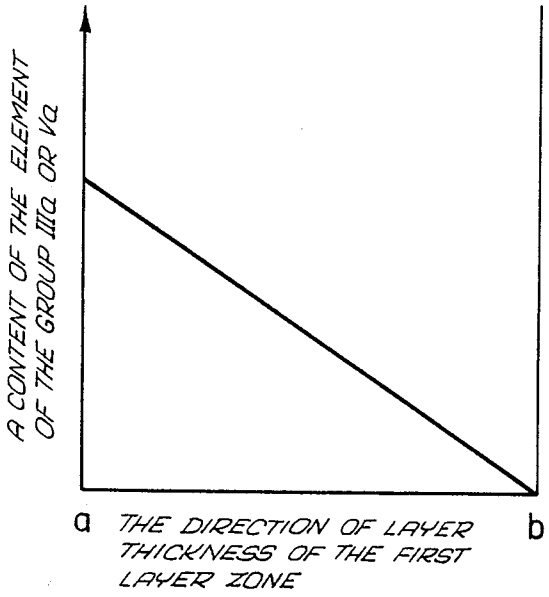
Figure 25:
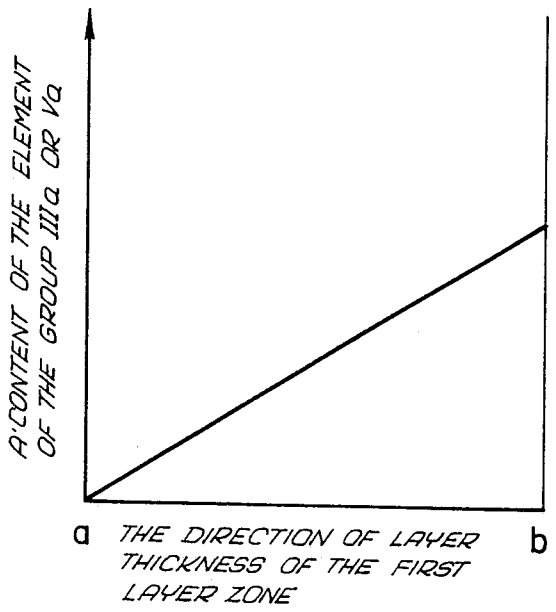
Figure 24:
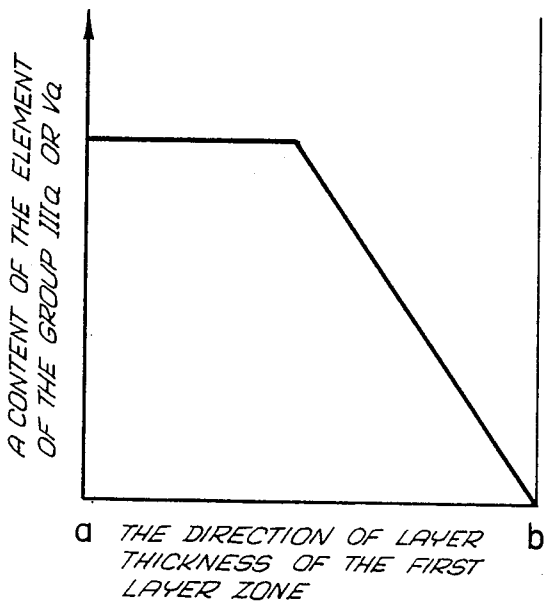
Figure 27:
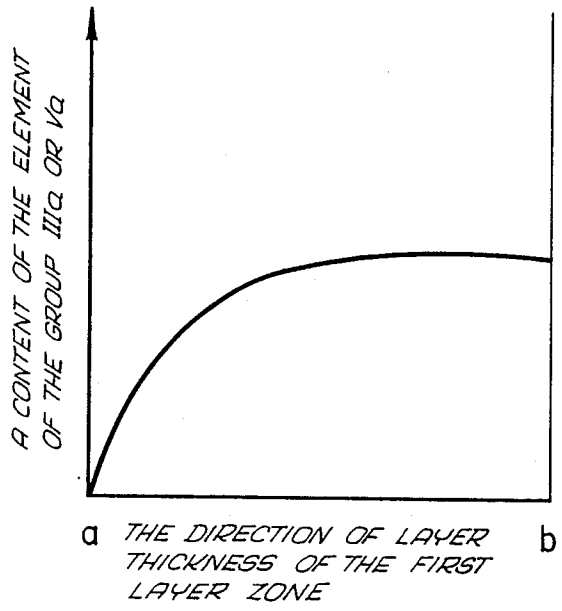
Figure 26:
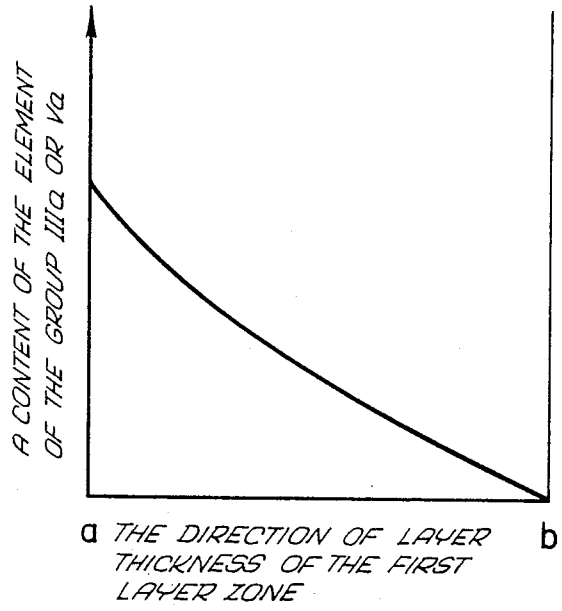
Figure 29:
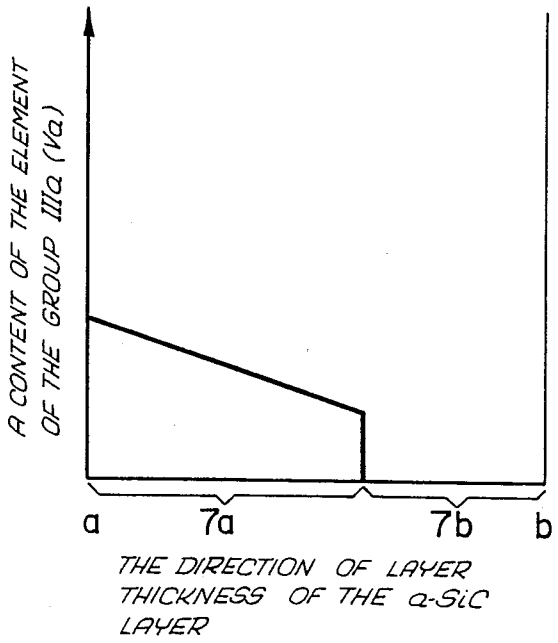
Figure 28:
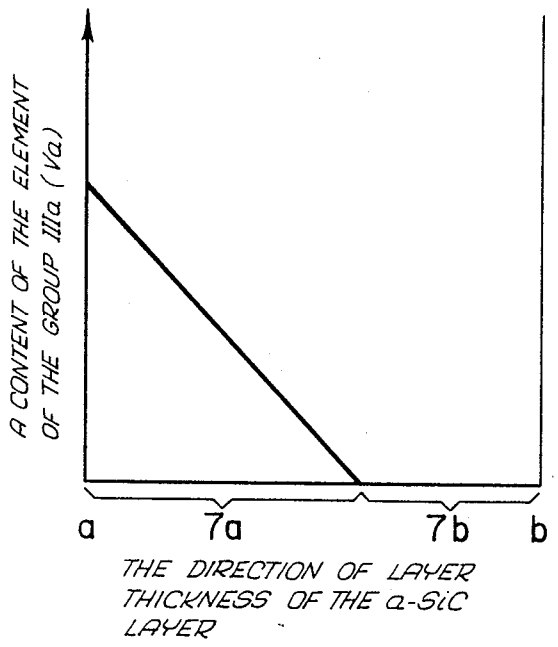
Figure 31:
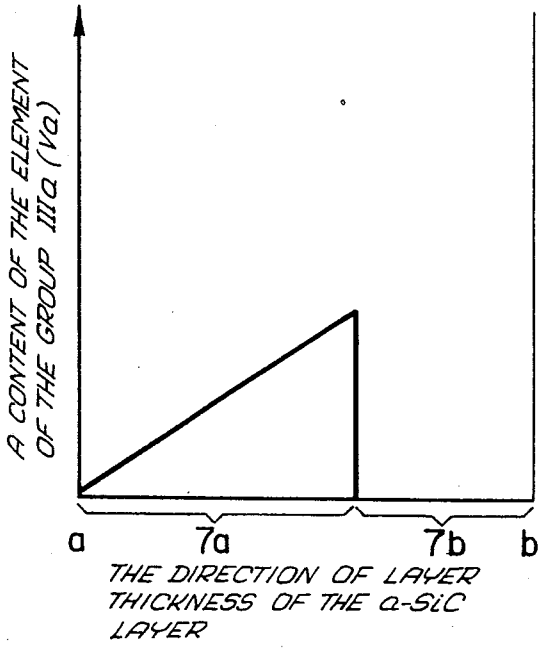
Figure 30:
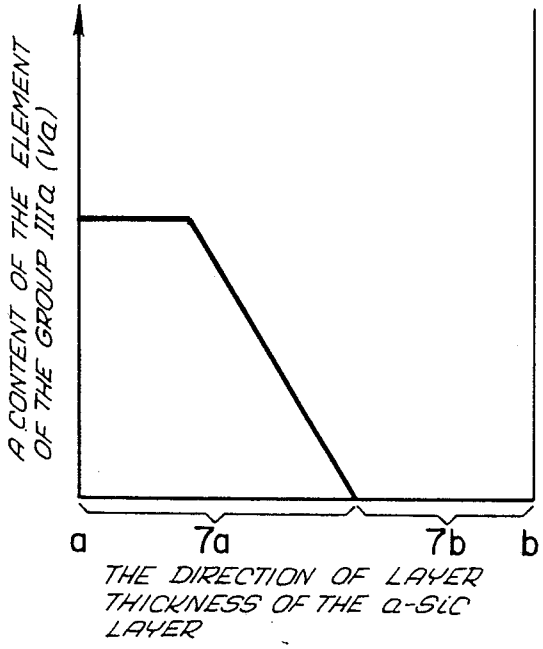
Figure 33:
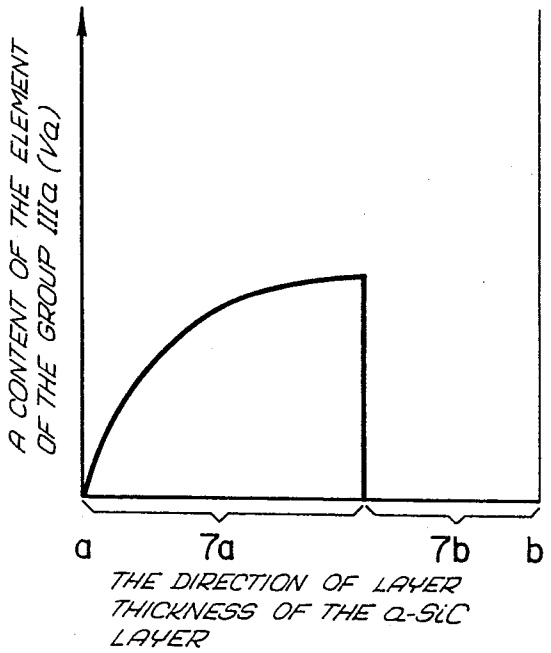
Figure 32:
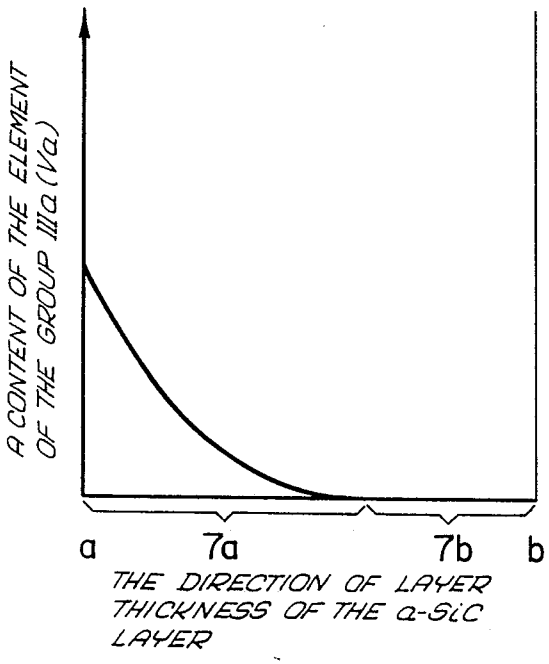
Figure 35:
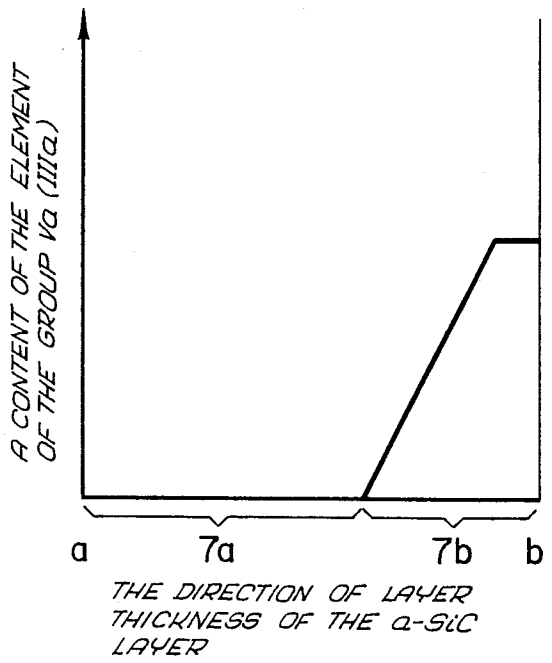
Figure 34:
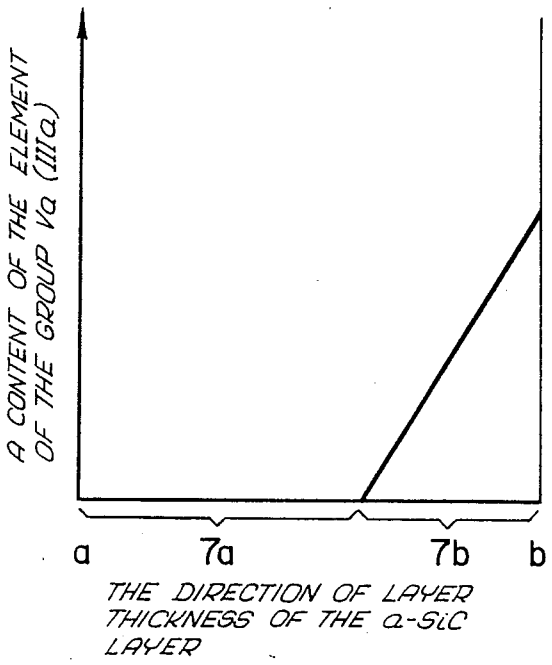
Figure 37:
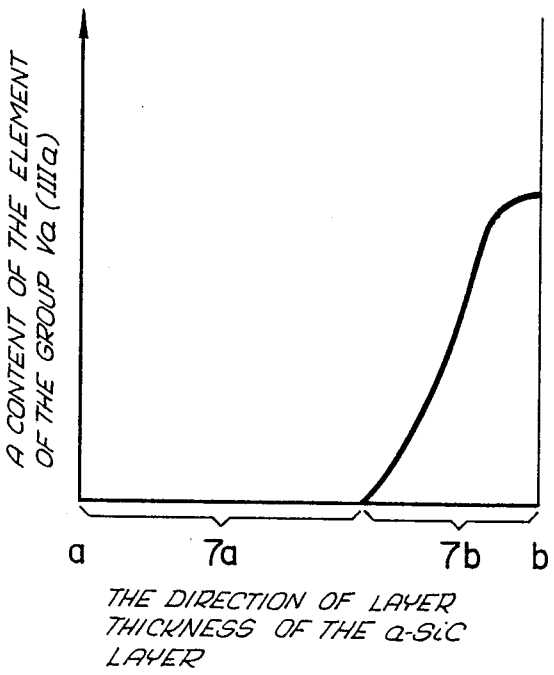
Figure 36:
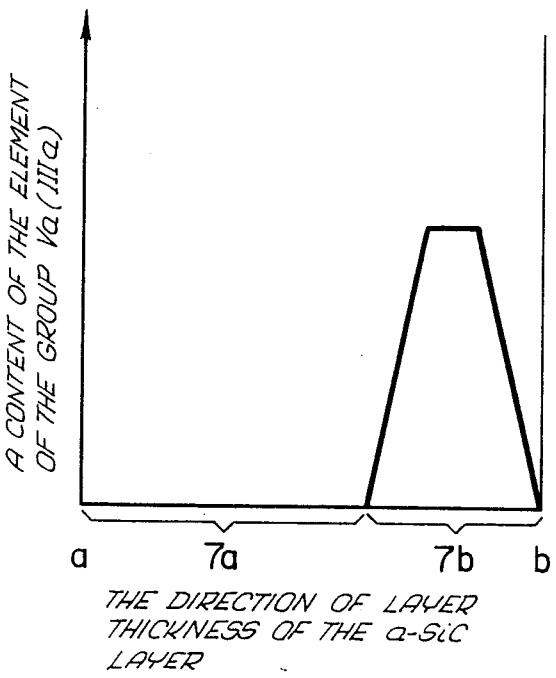
Figure 39:
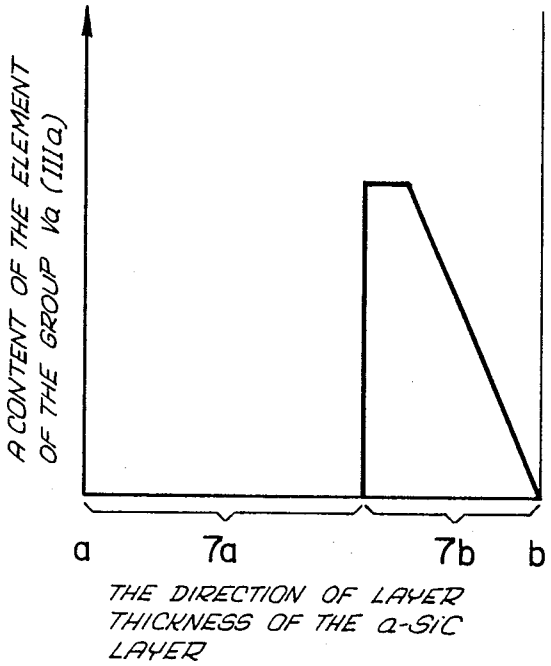
Figure 38:
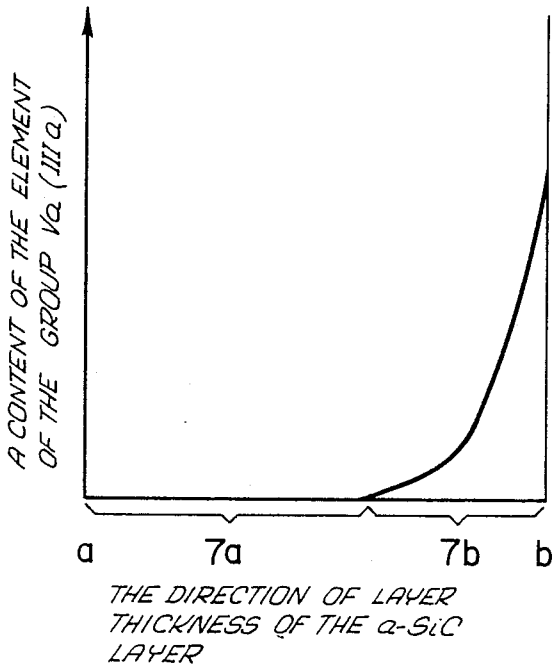

For example, FIG. 3*a* and FIG. 3*b* show a typical layer structure. Referring to FIG. 3*a*, 3*b*, a barrier layer (8) is formed between the substrate (5) and the a-Si layer (6) and a surface protective layer (9) is formed on the a-SiC layer (7).

Said barrier layer (8) aims at the hindrance of carriers from entering from the substrate (5) and said surface protective layer (9) aims at the protection of the a-SiC layer (7) and the improvement of the moisture resistance and the like. Moreover, both the layer (8) and the layer (9) all can reduce the dark conductivity of the photosensitive member and enhance the charge acceptance of the photosensitive member.

Every material having a high insulative property, a high corrosion resistance and a high hardness in itself can be used for this surface protective layer (9). For example, organic materials, such as polyimide resin, and inorganic materials, such as SiC, SiO, $Al_2O_3$ and SiN, can be used.

In addition, also the barrier layer (8) can be formed of the same materials as those for the above described surface protective layer (9).

Next, a method of producing the electrophotographic sensitive member according to the present invention will be described.

Thin film-forming methods, such as glow discharge decomposition method, ion plating method, reactive sputtering method, vacuum deposition method and CVD method, are used for the formation of the a-Si layer or the a-SiC layer.

In the case where the glow discharge decomposition method is used, a Si element-containing gas or a gas comprising said Si element-containing gas and a C element-containing gas in combination is subjected to the glow discharge decomposition. This Si element-containing gas includes $SiH_4$, $Si_2H_6$, $Si_3H_8$, $SiF_4$, $SiCl_4$, $SiHCl_3$ and the like. In addition, the C element-containing gas includes $CH_4$, $C_2H_4$, $C_2H_2$, $C_3H_8$ and the like. Above all, $C_2H_2$ is desirable in view of high-speed film forming property.

A capacitively couple type glow discharge decomposition apparatus used in the preferred embodiments of the present invention is below described with reference to FIG. 40.

Figure 40:
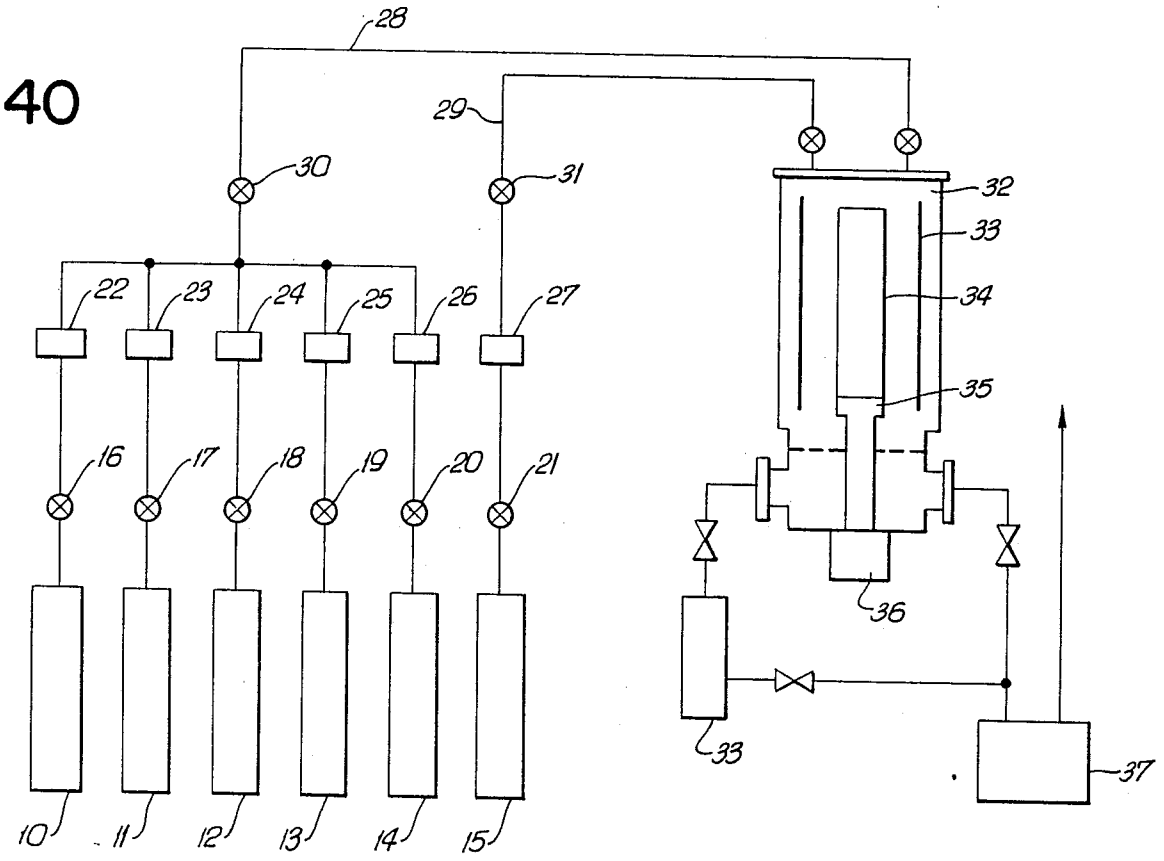
FIG. 40 is a schematic drawing showing a glow discharge decomposition apparatus and FIGS. 41 to 48 are graphs showing a spectral sensitivity.

Referring to FIG. 40, a first tank (10) encloses $SiH_4$, a second tank (11) $C_2H_2$, a third tank (12) $B_2H_6$ or $PH_3$ (every one is diluted with a $H_2$ gas until a concentration of 0.2%), a fourth tank (13) $B_2H_6$ or $PH_3$ (every one is diluted with a $H_2$ gas until a concentration of 38 ppm in the case of $B_2H_6$ and 40 ppm in the case of $PH_3$), a fifth tank (14) a $H_2$ gas and a sixth tank (15) a NO gas, respectively, therein. $H_2$ is used as a carrier gas. These gases are emitted from the respective tanks by opening the corresponding adjusting first, second, third, fourth, fifth and sixth valves (16), (17), (18), (19), (20), (21), their flow rates being controlled by means of the corresponding mass flow controllers (22), (23), (24), (25), (26), (27), the gases from the first, second, third, fourth and fifth tanks (10), (11), (12), (13), (14) being introduced into a first main pipe (28), and the NO gas from the sixth tank (15) being introduced into a second main pipe (29).

In addition, reference numerals (30), (31) designate a stop valve. The gases flowing through the main pipe (28) and the main pipe (29) are introduced into a reaction tube (32) but a capacitively coupled type discharging electrode (33) is disposed in this reaction tube (32).

A high-frequency electric power applied to said capacitively coupled type discharging electrode (33) of 50 W to 3 KW and a high-frequency applied to said capacitively coupled type discharging electrode (33) of 1 to 50 MHz are suitable. A cylindrical film-forming substrate (34) formed of aluminum is placed on a sample-holding table (35) within the reaction tube (32) and said sample-holding table (35) is adapted to be rotationally driven by means of a motor (36).

And, said substrate (34) is uniformly heated at about 200° to 400° C., preferably about 200° to 350° C., by suitable heating means. In addition, since a high depressurized condition (discharging pressure of 0.01 to 2.0 Torr) is required in an inside of the reaction tube (32) during the formation of the a-SiC film, the inside of the reaction tube (32) is connected with a rotary pump (37) and a diffusion pump (38).

With the glow discharge decomposition apparatus having the above described construction, in the case where for example in a-SiC film is formed on the substrate (34), the first, second and fifth adjusting valves (16), (17), (20) are opened to emit the $SiH_4$ gas, the $C_2H_2$ gas and the $H_2$ gas, respectively. Their quantities emitted are controlled by means of the mass flow controllers (22), (23), (26) and a gaseous mixture of $SiH_4$, $C_2H_2$ and $H_2$ is poured into the reaction tube (32) through the first main pipe (28).

And, when the inside of the reaction tube (32) is depressurized to an extent of about 0.01 to 2.0 Torr, the substrate temperature being set at 200° to 400° C., the high-frequency electric power applied to the capacitively coupled type discharging electrode (33) being set at 50 W to 3 KW, and the high-frequency applied to the capacitively coupled type discharging electrode (33) being set at 1 to 50 MHz, the glow discharge is brought about to decompose the gaseous mixture, whereby forming the a-SiC film on the substrate at high speed.

The present invention is below described with reference to the preferred embodiments thereof.

EXAMPLE 1

The photoconductive a-Si layer (6) and the photoconductive a-SiC layer (7) were formed on the aluminum substrate in layers in this order under the film-forming conditions as shown in Table 1 and Table 2 in the glow discharge decomposition apparatus shown in FIG. 40 to produce a photosensitive drum as shown in FIG. 2a.

In addition, a numerical value shown in a parenthesis for $B_2H_6$ or $PH_3$ in the tables designates a diluting concentration of the $B_2H_6$ gas or the $PH_3$ gas with the $H_2$ gas. This is similar also in Table 3 and thereafter which will be mentioned later.

TABLE 1

| Layer construction | Gas flow rate (sccm) $SiH_4$ | $C_2H_2$ | $H_2$ | $B_2H_6$ (38 ppm) | Gas pressure (Torr) | High frequency electric power (W) | Film forming time (min) | Thickness (μm) |
|---|---|---|---|---|---|---|---|---|
| Photoconductive a-SiC layer | 20 | 1 | 680 | 20 | 1.20 | 150 | 30 | 0.6 |
| Photoconductive a-Si layer | 220 | — | 250 | 1.7 | 0.60 | 150 | 300 | 25.0 |

TABLE 2

| Layer construction | Gas flow rate (sccm) $SiH_4$ | $C_2H_2$ | $H_2$ | $PH_3$ (40 ppm) | Gas pressure (Torr) | High frequency electric power (W) | Film forming time (min) | Thickness (μm) |
|---|---|---|---|---|---|---|---|---|
| Photoconductive a-SiC layer | 20 | 1 | 680 | 20 | 1.20 | 150 | 30 | 0.6 |
| Photoconductive a-Si layer | 220 | — | 250 | — | 0.60 | 150 | 300 | 25.0 |

A monochromatic light of 0.3 $\mu w/cm^2$ spectralized by means of a visible light spectrometer was incident upon the resulting photosensitive drum to determine a half-life period of charge acceptance, whereby measuring a spectral sensitivity. The results as shown in FIG. 41 were obtained for the photosensitIve drum produced under the conditions shown in Table 1 and the results as shown in FIG. 42 for the photosensitive drum produced under the conditions shown in Table 2.

Referring to these drawings, an axis of abscissa shows a wavelength, an axis of ordinate showing a photosensitivity, a ○ mark showing a plot of the results of measurement, and a showing a characteristic curve of the results of measurement.

Figure 41:
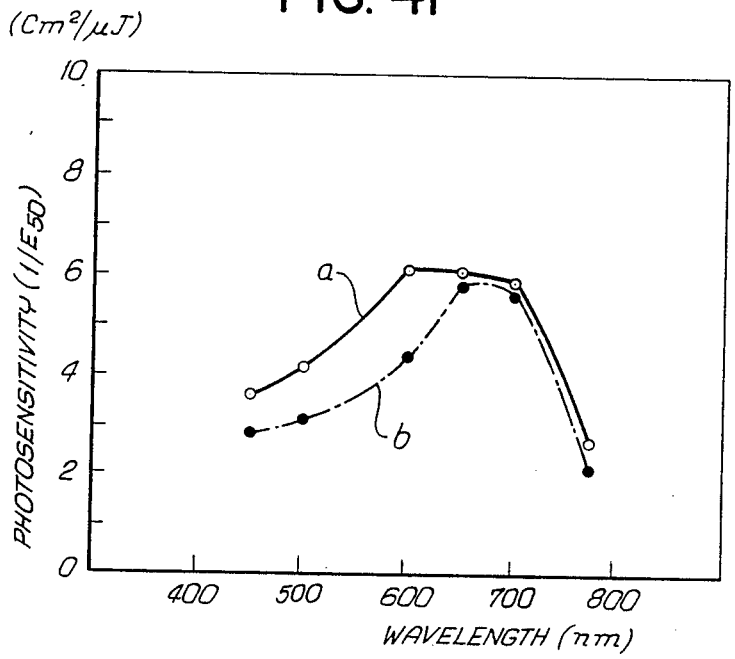
Figure 42:
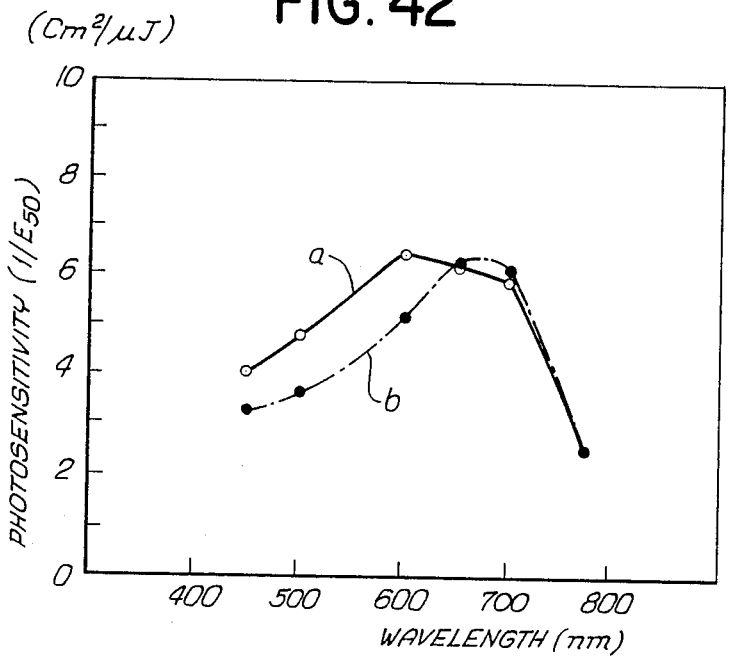

In addition, a photosensitive drum, which was produced by removing the photoconductive a-SiC layer from the above described photosensitive drum, is shown as the COMPARATIVE EXAMPLE in these FIGS. 41, 42. The spectral sensitivity of the former was measured with the plot of results of measurement shown by a ● mark. b shows a characteristic curve.

It is found from these results that the photosensitivity on the short wavelength side of the photosensitive drum according to the present invention is remarkably enhanced.

In addition, the quantity of carbon in the above described photoconductive a-SiC layer was determined by the ESCA analysis with the value x in $Si_{(1-x)}C_x$ of 0.12. Besides, the content of B or P in the above described photoconductive a-SiC layer was determined by the secondary ion mass spectrometer with the results that B was contained at 25 ppm and P was contained at 20 ppm.

EXAMPLE 2

The barrier layer (8), the photoconductive a-Si layer (6), the photoconductive a-SiC layer (7) and the surface protective layer (9) were formed on the aluminum substrate in layers in this order under the film-forming conditions as shown in the following Tables 3, 4 to produce a photosensitive drum as shown in FIG. 3*a*.

TABLE 3

| Layer construction | Gas flow rate (sccm) $SiH_4$ | $C_2H_2$ | $H_2$ | $B_2H_6$ (0.2%) | $B_2H_6$ (38 ppm) | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| Photoconductive a-SiC layer | 20 | 1 | 680 | — | 20 | — | 1.20 | 150 | 30 | 0.6 |
| Photoconductive a-Si layer | 220 | — | 250 | — | 1.7 | — | 0.60 | 150 | 300 | 25.0 |
| Carrier barrier layer | 80 | — | 280 | 60 | — | 2.5 | 0.45 | 75 | 90 | 3.0 |

TABLE 4

| Layer construction | Gas flow rate (sccm) $SiH_4$ | $C_2H_2$ | $H_2$ | $PH_3$ (0.2%) | $PH_3$ (40 ppm) | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| Photoconductive a-SiC layer | 20 | 1 | 680 | — | 20 | — | 1.20 | 150 | 30 | 0.6 |
| Photoconductive a-Si layer | 220 | — | 250 | — | — | — | 0.60 | 150 | 300 | 25.0 |
| Carrier barrier layer | 80 | — | 280 | 45 | — | 2.5 | 0.45 | 75 | 90 | 3.0 |

The resulting photosensitive drum was carried on the PPC and subjected to the irradiation of a light from a halogen lamp without using a red color-cutting filter and a voltage of +5.6 KV was applied to the photosensitive drum produced under the conditions shown in Table 3 by means of a corona charger to be positively charged and besides a voltage of −5.6 KV was applied to the photosensitive drum produced under the conditions as shown in Table 4 by means of a corona charger to be negatively charged and subsequently the charge acceptance, the photosensitivity and the residual potential were measured with the following results. The photosensitive drum produced under the conditions as shown in Table 3

| | |
|---|---|
| Charge acceptance | +390 V |
| Photosensitivity (recording exposure) | 0.54 lux · sec |
| Residual potential (a value after 5 seconds from the start of exposure) | 20 V |

The photosensitive drum produced under the conditions as shown in Table 4

| | |
|---|---|
| Charge acceptance | −380 V |
| Photosensitivity (recording exposure) | 0.52 lux · sec |
| Residual potential (a value after 5 seconds from the start of exposure) | 18 V |

In addition, the resulting photosensitive drums were carried on the high-speed PPC and tested on the taking-out of image at a speed of 50 pieces/minute with a faithful reproductivity for a black color portion and a red color portion and additionally a distinct image showing no background smearing but having a high concentration.

EXAMPLE 3

Photosensitive drums 1 to 7 produced by variously changing the thickness of the photoconductive a-SiC layer in the photosensitive drum produced under the conditions shown in Table 3 in EXAMPLE 2 were subjected to the measurements of the charge acceptance, the photosensitivity (recroding exposure) and the residual potential ( a value after 5 seconds from the start of exposure) with the results as shown in Table 5. In addition, the kind of the photosensitive drum in Table 5 marked with * is outside of the scope of the present invention. This is similar also in the tables shown hereinafter.

TABLE 5

| Kind of the photo-sensitive drum | Thickness of the a-SiC layer (μm) | Charge ac-ceptance (V) | Recording exposure (lux.sec) | Residual potential (V) |
|---|---|---|---|---|
| 1* | 0.03 | 350 | 0.81 | 10 |
| 2 | 0.08 | 365 | 0.68 | 15 |
| 3 | 0.3 | 374 | 0.56 | 18 |
| 4 | 1.0 | 380 | 0.54 | 24 |
| 5 | 2.0 | 360 | 0.54 | 33 |
| 6 | 4.0 | 377 | 0.58 | 35 |
| 7* | 6.0 | 383 | 0.56 | 45 |

It is obvious from Table 5 that the photosensitive drums 2 to 6 according to the present invention exhibit an enhanced charge acceptance, a reduced residual potential and a superior photosensitivity. However, the photosensitive drum 1 exhibits an inferior photosensitivity and the photosensitive drum 7 exhibits an increased residual potential.

EXAMPLE 4

Photosensitive drums 8 to 14 produced by variously changing the thickness of the photoconductive a-SiC layer in the photosensitive drum produced under the conditions shown in Table 4 in EXAMPLE 2 were subjected to the measurements of the charge acceptance, the photosensitivity (recording exposure) and the residual potential (a value after 5 seconds from the start of exposure) with the results as shown in Table 6.

TABLE 6

| Kind of the photo-sensitive drum | Thickness of the a-SiC layer (μm) | Charge ac-ceptance (V) | Recording exposure (lux.sec) | Residual potential (V) |
|---|---|---|---|---|
| 8* | 0.03 | −335 | 0.82 | 7 |
| 9 | 0.1 | −360 | 0.69 | 12 |
| 10 | 0.4 | −372 | 0.55 | 18 |
| 11 | 1.0 | −375 | 0.52 | 22 |
| 12 | 2.0 | −355 | 0.53 | 30 |
| 13 | 4.0 | −380 | 0.55 | 35 |
| 14* | 7.0 | −394 | 0.57 | 50 |

It is obvious from Table 6 that the photosensitive drums 9 to 13 according to the present invention exhibit an enhanced charge acceptance, a reduced residual potential and a superior photosensitivity.

However, the photosensitive drum 8 is inferior in photosensitivity and the photosensitive drum 14 exhibits an increased residual potential.

EXAMPLE 5

Photosensitive drums 15 to 22 produced by variously changing the carbon-content and the B-content in the photoconductive a-SiC layer of the photosensitive drums produced under the conditions shown in Table 3 in EXAMPLE 2 were subjected to the measurements of the charge acceptance, the photosensitivity (recording exposure) and the residual potential (a value after 5 seconds after the start of exposure) with the results as shown in Table 7.

TABLE 7

| Kind of the photo-sensitive drum | Carbon content (X-value) | B-content (ppm) | Charge ac-ceptance (V) | Recording exposure (lux.sec) | Residual po-tential (V) |
|---|---|---|---|---|---|
| 15* | 0.005 | 0.3 | 349 | 0.78 | 12 |
| 16* | 0.03 | 0.3 | 356 | 0.78 | 18 |
| 17 | 0.03 | 0.6 | 352 | 0.69 | 22 |

TABLE 7-continued

| Kind of the photo-sensitive drum | Carbon content (X-value) | B-content (ppm) | Charge ac-ceptance (V) | Recording exposure (lux.sec) | Residual po-tential (V) |
|---|---|---|---|---|---|
| 18 | 0.09 | 10 | 387 | 0.55 | 20 |
| 19 | 0.25 | 30 | 360 | 0.52 | 27 |
| 20 | 0.40 | 60 | 355 | 0.66 | 30 |
| 21* | 0.40 | 120 | 173 | 0.76 | 45 |
| 22* | 0.60 | 120 | 238 | 1.5 | 53 |

It is obvious from Table 7 that the photosensitive drums 17 to 20 according to the present invention exhibit an enhanced charge acceptance, a reduced residual potential and a superior photosensitivity.

However, the photosensitive drums 15, 16 are inferior in photosensitivity and the photosensitive drums 21, 22 exhibit a reduced charge acceptance, an increased residual potential and an inferior photosensitivity.

EXAMPLE 6

Photosensitive drums 23 to 30 produced by variously changing the carbon-content and the P-content in the photoconductive a-SiC layer of the photosensitive drums produced under the conditions shown in Table 4 in EXAMPLE 2 were subjected to the measurements of the charge acceptance, the photosensitivity (recording exposure) and the residual potential (a value after 5 seconds from the start of exposure) with the results as shown in Table 8.

TABLE 8

| Kind of the photo-sensitive drum | Carbon content (X-value) | P-content (ppm) | Charge ac-ceptance (V) | Recording exposure (lux · sec) | Residual po-tential (V) |
|---|---|---|---|---|---|
| 23* | 0.004 | 0.3 | −338 | 0.79 | 9 |
| 24* | 0.04 | 0.3 | −350 | 0.80 | 15 |
| 25 | 0.04 | 0.8 | −358 | 0.68 | 19 |
| 26 | 0.14 | 10 | −376 | 0.59 | 18 |
| 27 | 0.28 | 40 | −354 | 0.50 | 28 |
| 28 | 0.40 | 60 | −322 | 0.63 | 30 |
| 29* | 0.40 | 140 | −146 | 0.74 | 48 |
| 30* | 0.65 | 140 | −222 | 1.3 | 50 |

It is obvious from Table 8 that the photosensitive drums 25 to 28 according to the present invention exhibit an enhanced charge acceptance, a reduced residual potential and a superior photosensitivity.

However, the photosensitive drums 23, 24 are inferior in photosensitivity and the photosensitive drums 29, 30 exhibit a reduced charge acceptance, an increased residual potential and an inferior photosensitivity.

In addition, the present inventors placed the above described photosensitive drums 2 to 6, 9 to 13, 17 to 20 and 25 to 28 on the high-speed PPC and tested on taking-out of image at a speed of 50 pieces/minute with the confirmation that the faithful reproductivity for a black color portion and a red color portion is obtained and a distinct image having no background smearing but a high concentration can be obtained.

EXAMPLE 7

The photoconductive a-Si layer (6) and the photoconductive a-SiC layer (7) were formed on the aluminum substrate in layers in this order under the conditions as shown in the following Tables 9, 10 in the same manner as in EXAMPLE 1 to produce a photosensitive drum as shown in FIG. *2a*.

In addition, an arrow marked with * shows a flow rate from the start of film-formation to the finish of film-formation.

TABLE 9

| Layer construction | Gas flow rate (sccm) $SiH_4$ | $C_2H_2$ | $H_2$ | $B_2H_6$ (38 ppm) | Gas pressure (Torr) | High frequency electric power (W) | Film forming time (min) | Thickness (μm) |
|---|---|---|---|---|---|---|---|---|
| Photoconductive a-SiC layer | 20 | 1 | 680 | 20 → 0* | 1.20 | 150 | 30 | 0.4 |
| Photoconductive a-Si layer | 220 | — | 250 | 1.7 | 0.60 | 150 | 300 | 25.0 |

TABLE 10

| Layer construction | Gas flow rate (sccm) $SiH_4$ | $C_2H_2$ | $H_2$ | $PH_3$ (40 ppm) | Gas pressure (Torr) | High frequency electric power (W) | Film forming time (min) | Thickness (μm) |
|---|---|---|---|---|---|---|---|---|
| Photoconductive a-SiC layer | 20 | 1 | 680 | 20 → 0* | 1.20 | 150 | 30 | 0.4 |
| Photoconductive a-Si layer | 220 | — | 250 | — | 0.60 | 150 | 300 | 25.0 |

Figure 43:
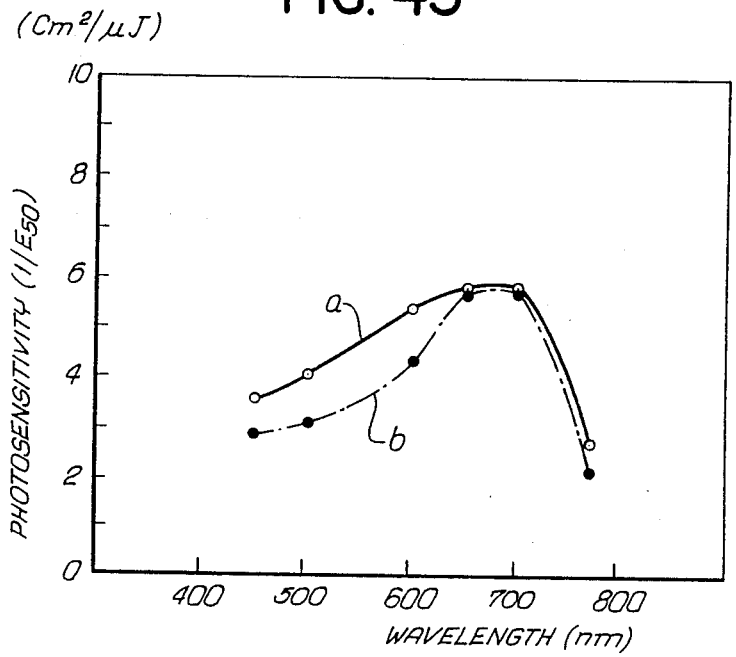
Figure 44:
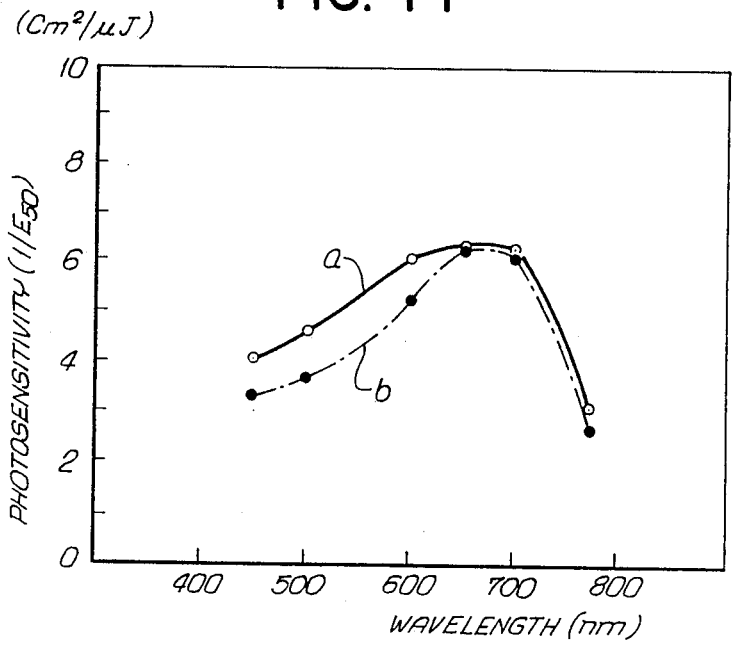

The resulting photosensitive drums were subjected to the irradiation of a monochromatic light of 0.3 $\mu W/cm^2$ spectralized by means of a visible light spectrometer to determine a half-life period of charge acceptance and measure the photosensitivity with the results shown in FIG. 43 for the photosensitive drum produced under the conditions shown in Table 9 and in FIG. 44 for the photosensitive drum produced under the conditions shown in Table 10, respectively.

Referring to these drawings, an axis of abscissa shows a wavelength, an axis of ordinate showing a photosensitivity, a O mark showing a plot of the result of measurement, and a showing a characteristic curve of the result of measurement.

In addition, a photosensitive drum produced by removing the photoconductive a-SiC layer from the above described photosensitive drums is shown as the COMPARATIVE EXAMPLE in FIGS. 43, 44. The spectral sensitivity of such the photosensitive drum was measured with a plot of the result of measurement shown by a ● mark. b shows a characteristic curve of the result of measurement.

It is obvious from these results that the photosensitive drums according to the present invention exhibit a remarkably enhanced photosensitivity on the short wavelength side.

Besides, a quantity of carbon in the above described photoconductive a-SiC layer was determined by the ESCA analysis with a result that the x value in $Si_{(1-x)}C_x$ amounts to 0.12. Furthermore, the maximum B-content or the maximum P-content in the photoconductive a-SiC layer was determined by the secondary ion mass spectrometer with the result that the maximum B-content is 25 ppm and the maximum P-content is 20 ppm.

EXAMPLE 8

The barrier layer (8), the photoconductive a-Si layer (6), the photoconductive a-SiC layer (7) and the surface protective layer (9) were formed on the aluminum substrate in layers in this order under the conditions as shown in the following Tables 11, 12 to produce a photosensitive drum as shown in FIG. 3*a*.

TABLE 11

| Layer construction | Gas flow rate (sccm) $SiH_4$ | $C_2H_2$ | $H_2$ | $B_2H_6$ (0.2%) | $B_2H_6$ (38 ppm) | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| Photoconductive a-SiC layer | 20 | 1 | 680 | 20→0* | — | — | 1.20 | 150 | 20 | 0.4 |
| Photoconductive a-Si layer | 220 | — | 250 | — | 1.7 | — | 0.60 | 150 | 300 | 25.0 |
| Carrier barrier layer | 80 | — | 280 | 60 | — | 2.5 | 0.45 | 75 | 90 | 3.0 |

TABLE 12

| Layer construction | Gas flow rate (sccm) $SiH_4$ | $C_2H_2$ | $H_2$ | $PH_3$ (0.2%) | $PH_3$ (40 ppm) | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| Photoconductive a-SiC layer | 20 | 1 | 680 | 20→0* | — | — | 1.20 | 150 | 20 | 0.4 |
| Photoconductive a-Si layer | 220 | — | 250 | — | — | — | 0.60 | 150 | 300 | 25.0 |
| Carrier barrier layer | 80 | — | 280 | 45 | — | 2.5 | 0.45 | 75 | 90 | 3.0 |

The resulting photosensitive drum was carried on the PPC and subjected to the irradiation of a light from a halogen lamp without using a red color-cutting filter and the photosensitive drums produced under the conditions shown in Table 11 being subjected to the application of a voltage of +5.6 KV by means of a corona charger to be positively charged, and the photosensitive drums produced under the conditions shown in Table 12 being subjected to the application of a voltage of −5.6 KV by means of a corona charger to be negatively charged followed by the measurements of the charge acceptance, the photosensitivity and the residual potential with the following results. The photosensitive drum produced under the conditions shown in Table 11

| | |
|---|---|
| Charge acceptance | +495 V |
| Photosensitivity (recording exposure) | 0.56 lux · sec |
| Residual potential (a value after 5 seconds from the start of exposure) | 22 V |

The photosensitive drum produced under the conditions shown in Table 12

| | |
|---|---|
| Charge acceptance | −472 V |
| Photosensitivity (recording exposure) | 0.53 lux · sec |
| Residual potential (a value after 5 seconds from the start of exposure) | 20 V |

In addition, these photosensitive drum was carried on the high-speed PPC and tested on taking-out of image at a speed of 70 pieces/minute with the results that that the faithful reproductivity for a black color portion and a red color portion is obtained and the distinct image having no background smearing but a high concentration can be obtained.

EXAMPLE 9

The photosensitive drum produced in the same manner as in EXAMPLE 8 excepting that the B-content in the photoconductive a-SiC layer (7) of the photosensitive drum produced under the conditions shown in Table 11 in EXAMPLE 8 is uniformly set in the direction of layer thickness at 25 ppm, was subjected to the measurement of the electrophotographic characteristics with the following results.

| | |
|---|---|
| Charge acceptance | +390 V |
| Photosensitivity (recording exposure) | 0.54 lux · sec |
| Residual potential (a value after 5 seconds from the start of exposure) | 20 V |

EXAMPLE 10

The photosensitive drum produced in the same manner as in EXAMPLE 8, excepting that the P-content in the photoconductive a-SiC layer (7) of the photosensitive drum produced under the conditions shown in Table 12 in EXAMPLE 8 is uniformly set in the direction of layer thickness at 5 ppm, was subjected to the measurement of the electrophotographic characteristics with the following results.

| | |
|---|---|
| Charge acceptance | −370 V |
| Photosensitivity (recording exposure | 0.50 lux · sec |
| Residual potential (a value after 5 seconds from the start of exposure) | 17 V |

As obvious from the above described results in EXAMPLE 9, 10, the residual potential is reduced to some extent and also the photosensitivity is enhanced to some extent but the charge acceptance is remarkably reduced.

EXAMPLE 11

The photosensitive drums 31 to 36 produced under the conditions shown in Table 11 in EXAMPLE 8, excepting that the thickness of the photoconductive a-SiC layer is variously changed with setting the maximum B-content at 25 ppm, were subjected to the measurement of the electrophotographic characteristics with the results shown in Table 13.

TABLE 13

| Kind of the photo sensitivie drum | Thickness of the a-SiC layer (μm) | Charge acceptance (V) | Recording exposure (lux · sec) | Residual potential (V) |
|---|---|---|---|---|
| 31* | 0.03 | 333 | 0.75 | 15 |
| 32 | 0.08 | 465 | 0.69 | 18 |
| 33 | 0.8 | 507 | 0.59 | 23 |
| 34 | 2.0 | 520 | 0.60 | 26 |
| 35 | 4.0 | 525 | 0.68 | 32 |

TABLE 13-continued

| Kind of the photo sensitivie drum | Thickness of the a-SiC layer (μm) | Charge ac-ceptance (V) | Recording exposure (lux · sec) | Residual potential (V) |
|---|---|---|---|---|
| 36* | 6.0 | 544 | 0.70 | 53 |

EXAMPLE 12

The photosensitive drum 37 to 42 produced under the conditions shown in Table 12 in EXAMPLE 8, excepting that the thickness of the photoconductive a-SiC layer is variously changed with setting the maximum P-content at 5 ppm, were subjected to the measurement of the electrophotographic characteristics with the results shown in Table 14.

TABLE 14

| Kind of the photo sensitive drum | Thickness of the a-SiC layer (μm) | Charge ac-ceptance (V) | Recording exposure (lux · sec) | Residual potential (V) |
|---|---|---|---|---|
| 37* | 0.03 | −320 | 0.74 | 13 |
| 38 | 0.07 | −457 | 0.65 | 19 |
| 39 | 0.5 | −498 | 0.53 | 20 |
| 40 | 2.0 | −513 | 0.55 | 25 |
| 41 | 3.5 | −515 | 0.66 | 30 |
| 42* | 7.0 | −522 | 0.73 | 51 |

EXAMPLE 13

The photosensitive drums 43 to 50 produced under the conditions shown in Table 11 in EXAMPLE 8, excepting that the carbon-content and the B-content in the photoconductive a-SiC layer were variously changed were subjected to the measurements of the electrophotographic characteristics with the results shown in Table 15.

In addition, the above described B-content is gradually reduced in the same manner as in Table 11 in EXAMPLE 8 and its quantity is a mean value per the a-SiC layer (7) as a whole.

TABLE 15

| Kind of the photo-sensitive drum | Carbon content (X-value) | B-content (ppm) | Charge accep-tance (V) | Recording exposure (lux · sec) | Residual po-tential (V) |
|---|---|---|---|---|---|
| 43* | 0.005 | 0.3 | 438 | 0.78 | 17 |
| 44* | 0.03 | 0.3 | 460 | 0.78 | 24 |
| 45 | 0.03 | 0.6 | 475 | 0.66 | 23 |
| 46 | 0.09 | 10 | 513 | 0.56 | 20 |
| 47 | 0.25 | 30 | 498 | 0.55 | 32 |
| 48 | 0.40 | 60 | 415 | 0.68 | 32 |
| 49* | 0.40 | 120 | 204 | 0.79 | 49 |
| 50* | 0.60 | 120 | 289 | 1.3 | 50 |

EXAMPLE 14

The photosensitive drums 51 to 58 produced under the conditions shown in Table 12 in EXAMPLE 8, excepting that the carbon-content and the P-content in the photoconductive a-SiC layer were variously changed, were subjected to the measurements of the electrophotographic characteristics with the results shown in Table 16.

In addition, the above described P-content is gradually reduced in the same manner as in Table 12 in EXAMPLE 8 and its quantity is a mean value per the a-SiC layer (7) as a whole.

TABLE 16

| Kind of the photo-sensitivie drum | Carbon content (X-value) | P-content (ppm) | Charge accep-tance (V) | Recording exposure (lux · sec) | Residual po-tential (V) |
|---|---|---|---|---|---|
| 51* | 0.004 | 0.3 | −425 | 0.77 | 15 |
| 52* | 0.04 | 0.3 | −444 | 0.77 | 20 |
| 53 | 0.04 | 0.8 | −462 | 0.64 | 22 |
| 54 | 0.14 | 10 | −503 | 0.53 | 18 |
| 55 | 0.28 | 40 | −470 | 0.53 | 28 |
| 56 | 0.40 | 60 | −403 | 0.63 | 30 |
| 57* | 0.40 | 140 | −188 | 0.81 | 48 |
| 58* | 0.65 | 140 | −260 | 1.4 | 52 |

It is obvious from the above described Tables 15, 16 that the photosensitive drums 45 to 48 and 53 to 56 according to the present invention exhibit the enhanced charge acceptance, the reduced potential and the superior photosensitivity.

However, the photosensitive drums 43, 44, 51, 52 are inferior in photosensitivity, the photosensitive drums 49, 50, 57, 58 exhibiting the reduced charge acceptance, the increased residual potential and the inferior photosensitivity.

In addition, the present inventors carried the photosensitive drums 32 to 35, 38 to 41, 45 to 48 and 53 to 56, respectively, on the high-speed PPC, which were tested on taking-out of image at a speed of 70 pieces/minute with the confirmation that the faithful reproductivity for a black color portion and a red color portion is obtained and the distinct image having no background smearing but a high concentration can be obtained.

EXAMPLE 15

The photoconductive a-Si layer (6), the first layer zone (*7a*) and the second layer zone (*7b*) were formed on the aluminum substrate in layers in this order under the film-forming conditions as shown in Tables 17, 18 by the use of the glow discharge decomposition apparatus shown in FIG. 40 to produce photosensitive drums as shown in FIG. 2*b*.

TABLE 17

| Layer construction | Gas flow rate (sccm) $SiH_4$ | $C_2H_2$ | $H_2$ | $B_2H_6$ (38 ppm) | Gas pressure (Torr) | High frequency electric power (W) | Film forming time (min) | Thick-ness (μm) |
|---|---|---|---|---|---|---|---|---|
| Second layer zone | 20 | 1 | 700 | — | 1.20 | 150 | 5 | 0.1 |
| First layer zone | 20 | 1 | 680 | 20 | 1.20 | 150 | 15 | 0.3 |
| Photo-conductive a-Si layer | 220 | — | 250 | 1.7 | 0.60 | 150 | 300 | 25.0 |

TABLE 18

| Layer construction | Gas flow rate (sccm) $SiH_4$ | $C_2H_2$ | $H_2$ | $PH_3$ (40 ppm) | Gas pressure (Torr) | High frequency electric power (W) | Film forming time (min) | Thickness (μm) |
|---|---|---|---|---|---|---|---|---|
| Second layer zone | 20 | 1 | 700 | — | 1.20 | 150 | 5 | 0.1 |
| First layer zone | 20 | 1 | 680 | 20 | 1.20 | 150 | 15 | 0.3 |
| Photoconductive a-Si layer | 220 | — | 250 | — | 0.60 | 150 | 300 | 25.0 |

Figure 45:
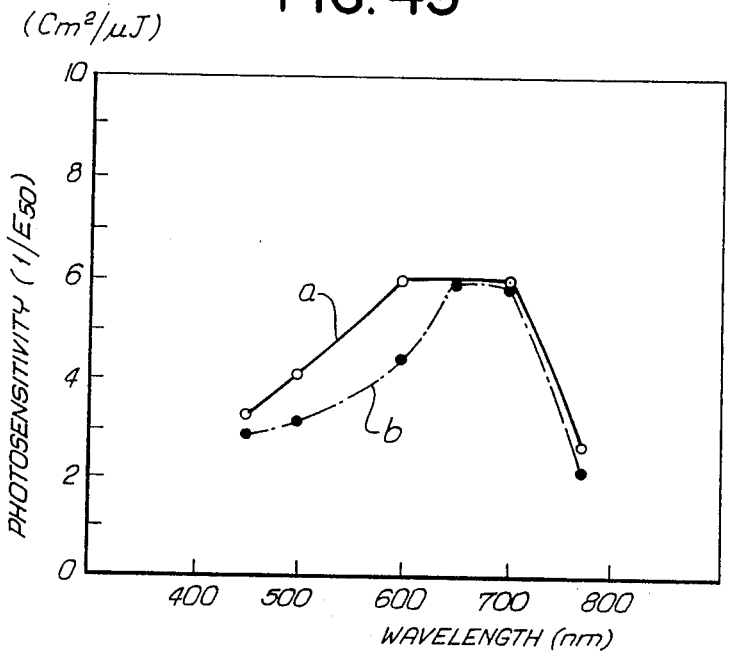
Figure 46:
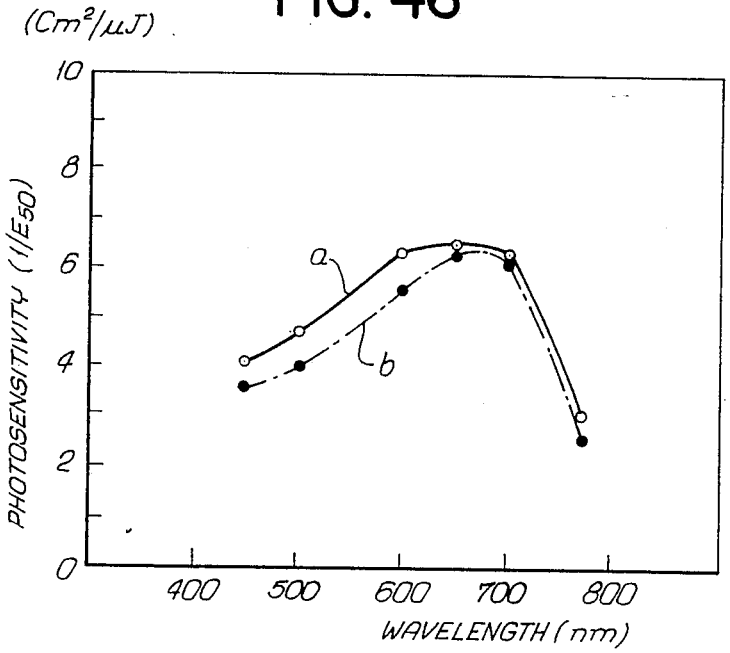

The resulting photosensitive drums were subjected to the irradiation of the monochromatic light of 0.3 $\mu W/cm^2$ spectralized by the visible light spectrometer to determine a half-life period of charge acceptance and measure the spectral sensitivity with the result as shown in FIG. 45 for the photosensitive drum produced under the conditions shown in Table 17 and that as shown in FIG. 46 for the photosensitive drum produced under the conditions shown in Table 18.

Referring to these drawings, an axis of abscissa shows a wavelength, an axis of ordinate showing a photosensitivity, a ○ mark showing a plot of the results of measurement, and a being a characteristic curve of the resulting photosensitive drum.

In addition, the photosensitive drums produced by removing the second layer zone from the above described photosensitive drums are shown in the above described FIGS. 45, 46 as COMPARATIVE EXAMPLE. The photosensitive drums were subjected to the measurement of the spectral sensitivity with a plot of the results of measurement shown by a ● mark. b is a characteristic curve of the photosensitive drums.

It is obvious from these results that the photosensitive drums according to the present invention exhibit the remarkably enhanced photosensitivity on the short wavelength side.

Besides, the quantity of carbon in the above described photoconductive a-SiC layer was determined by the ESCA analysis with the result that the x-value in $Si_{(1-x)}C_x$ amounts to 0.12 and furthermore the B-content or the P-content in the above described photoconductive a-SiC layer was determined with the result that the B-content is 25 ppm and the P-content is 20 ppm.

EXAMPLE 16

The barrier layer (8), the photoconductive a-Si layer (6), the photoconductive a-SiC layer (7) and the surface protective layer (9) were formed on the aluminum substrate in layers in this order under the film-forming conditions as shown in the following Tables 19, 20 to produce photosensitive drums as shown in FIG. 3*b*.

TABLE 19

| Layer construction | Gas flow rate (sccm) $SiH_4$ | $C_2H_2$ | $H_2$ | $B_2H_6$ (0.2%) | $B_2H_6$ (38 ppm) | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| Second layer zone | 20 | 1 | 700 | — | — | — | 1.20 | 150 | 5 | 0.1 |
| First layer zone | 20 | 1 | 680 | — | 20 | — | 1.20 | 150 | 15 | 0.3 |
| Photoconductive a-Si layer | 220 | — | 250 | — | 1.7 | — | 0.60 | 150 | 300 | 25.0 |
| Carrier barrier layer | 80 | — | 280 | 60 | — | 2.5 | 0.45 | 75 | 90 | 3.0 |

TABLE 20

| Layer construction | Gas flow rate (sccm) $SiH_4$ | $C_2H_2$ | $H_2$ | $PH_3$ (0.2%) | $PH_3$ (40 ppm) | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| Second layer zone | 20 | 1 | 700 | — | — | — | 1.20 | 150 | 5 | 0.1 |
| First layer zone | 20 | 1 | 680 | — | 20 | — | 1.20 | 150 | 15 | 0.3 |
| Photoconductive | 220 | — | 250 | — | — | — | 0.60 | 150 | 300 | 25.0 |

TABLE 20-continued

| Layer construction | Gas flow rate (sccm) $SiH_4$ | $C_2H_2$ | $H_2$ | $PH_3$ (0.2%) | $PH_3$ (40 ppm) | NO | Gas pressure (Torr) | High frequency electric power (W) | Film forming time (min) | Thickness (μm) |
|---|---|---|---|---|---|---|---|---|---|---|
| a-Si layer | | | | | | | | | | |
| Carrier barrier layer | 80 | — | 280 | 45 | — | 2.5 | 0.45 | 75 | 90 | 3.0 |

The resulting photosensitive drums were carried on the PPC and subjected to the irradiation of a light from a halogen lamp without using a red color-cutting filter and additionally a voltage of +5.6 KV was applied to the photosensitive drum produced under the conditions shown in Table 19 by means of a corona charger to positively charge the photosensitive drum while a voltage of −5.6 KV was applied to the photosensitive drum produced under the conditions shown in Table 20 by means of a corona charger to negatively charge the photosensitive drum followed by the measurements of the charge acceptance, the photosensitivity and the residual potential with the following results. The photosensitive drum produced under the conditions shown in Table 19

| | |
|---|---|
| Charge acceptance | +513 V |
| Photosensitivity (recording exposure) | 0.57 lux · sec |
| Residual potential (a value after 5 seconds from the start of exposure) | 25 V |

The photosensitive drum produced under the conditions shown in Table 20

| | |
|---|---|
| Charge acceptance | −498 V |
| Photosensitivity (recording exposure) | 0.54 lux · sec |
| Residual potential (a value after 5 seconds from the start of exposure) | 22 V |

In addition, these photosensitive drums were carried on the high-speed PPC and subjected to the image-taking out test at a speed of 70 pieces/min with the result that the faithful reproductivity for a black color portion and a red color portion is obtained and the distinct image having no background smearing but a high concentration can be obtained.

EXAMPLE 17

The photosensitive drums produced by removing the second layer zone from the photosensitive drums produced under the conditions shown in Tables 19, 20 in EXAMPLE 16, other layers being formed in the same manner as shown in EXAMPLE 16, were subjected to the measurements of electrophotographic characteristics with the following results. The photosensitive drum produced under the conditions shown in Table 19

| | |
|---|---|
| Charge acceptance | +390 V |
| Photosensitivity (recording exposure) | 0.54 lux · sec |
| Residual potential (a value after 5 seconds from the start of exposure) | 20 V |

-continued

The photosensitive drum produced under the conditions shown in Table 20

| | |
|---|---|
| Charge acceptance | −370 V |
| Photosensitivity (recording exposure) | 0.50 lux · sec |
| Residual potential (a value after 5 seconds from the start of exposure) | 18 V |

It is obvious from these results that the residual potential is reduced to some extent and also the photosensitivity is enhanced to some extent but the charge acceptance is remarkably reduced.

EXAMPLE 18

The photosensitive drums produced by reversing the order of forming the first layer zone and the second layer zone in the photosensitive drums produced under the conditions shown in Tables 19, 20 in EXAMPLE 16, that is, forming the second layer zone and the first layer zone on the a-Si layer in layers in this order and forming other layers in the same manner as shown in EXAMPLE 16, were subjected to the measurements of electrophotographic characteristics with the following results. The photosensitive drum produced under the conditions shown in Table 19

| | |
|---|---|
| Charge acceptance | +373 V |
| Photosensitivity (recording exposure) | 0.55 lux · sec |
| Residual potential (a value after 5 seconds from the start of exposure) | 22 V |

The photosensitive drum produced under the conditions shown in Table 20

| | |
|---|---|
| Charge acceptance | −368 V |
| Photosensitivity (recording exposure) | 0.52 lux · sec |
| Residual potential (a value after 5 seconds from the start of exposure) | 20 V |

It is obvious from these results that also these photosensitive drums exhibit a remarkably reduced charge acceptance.

EXAMPLE 19

The photosensitive drums 59 to 67 produced under the same conditions as those shown in Table 19 in EX- AMPLE 16, excepting that the thicknesses of the photoconductive a-SiC layer and the second layer zone are variously changed, were subjected to the measurements of electrophotographic characteristics with the results as shown in Table 21.

TABLE 21

| Kind of the photo-sensitive drum | Thick-ness of the a-SiC layer (μm) | Thick-ness of the first layer zone (μm) | Charge accep-tance (V) | Record-ing ex-posure (lux · sec) | Re-sidual po-tential (V) |
|---|---|---|---|---|---|
| 59* | 0.03 | 0.01 | 364 | 0.83 | 18 |
| 60* | 0.08 | 0.01 | 370 | 0.70 | 16 |
| 61 | 0.08 | 0.03 | 475 | 0.71 | 20 |
| 62 | 0.5 | 0.1 | 523 | 0.56 | 24 |
| 63 | 2.0 | 0.5 | 515 | 0.57 | 25 |
| 64 | 4.0 | 0.1 | 530 | 0.59 | 33 |
| 65 | 4.0 | 1.5 | 533 | 0.60 | 35 |
| 66* | 4.0 | 3.0 | 586 | 0.70 | 42 |
| 67* | 6.0 | 3.0 | 595 | 0.71 | 50 |

EXAMPLE 20

The photosensitive drums 68 to 76 produced under the same conditions as those shown in Table 20 in EXAMPLE 16, excepting that the thicknesses of the photoconductive a-SiC layer and the second layer zone are variously changed, were subjected to the measurements of electrophotographic characteristics with the results as shown in Table 22.

TABLE 22

| Kind of the photo-sensitive drum | Thick-ness of the first layer zone (μm) | Thick-ness of the second layer zone (μm) | Charge accep-tance (V) | Record ing ex-posure (lux · sec) | Re-sidual po-tential (V) |
|---|---|---|---|---|---|
| 68* | 0.02 | 0.01 | −350 | 0.80 | 12 |
| 69* | 0.07 | 0.01 | −365 | 0.68 | 15 |
| 70 | 0.07 | 0.04 | −458 | 0.70 | 18 |
| 71 | 0.5 | 0.1 | −513 | 0.53 | 20 |
| 72 | 1.5 | 0.5 | −500 | 0.55 | 22 |
| 73 | 4.0 | 0.1 | −525 | 0.55 | 29 |
| 74 | 4.0 | 1.3 | −523 | 0.58 | 34 |
| 75* | 4.0 | 3.0 | −572 | 0.68 | 43 |
| 76* | 7.0 | 3.0 | −580 | 0.72 | 52 |

It is obvious from the above described Tables 21, 22 that the photosensitive drums 61 to 65 and 70 to 74 according to the present invention exhibit the enhanced charge acceptance, the reduced residual potential and the superior photosensitivity.

However, the photosensitive drums 59, 68 are inferior in photosensitivity and charge acceptance, the photosensitive drums 60, 69 being inferior in charge acceptance, and the photosensitive drums 66, 67, 75, 76 exhibiting the increased residual potential.

EXAMPLE 21

The photosensitive drums 77 to 84 produced under the same conditions as those shown in Table 19 in EXAMPLE 16, excepting that the quantity of carbon in the photoconductive a-SiC layer and the B-content in the first layer zone are variously changed, were subjected to the measurements of electrophotographic characteristics with the results as shown in Table 23.

TABLE 23

| Kind of the photo-sensitive drum | Quantity of carbon as an X-value | B-content (ppm) | Charge accep-tance (V) | Record-ing ex-posure (lux · sec) | Re-sidual po-tential (V) |
|---|---|---|---|---|---|
| 77* | 0.005 | 0.3 | 450 | 0.80 | 18 |
| 78* | 0.03 | 0.3 | 475 | 0.78 | 22 |
| 79 | 0.03 | 0.6 | 483 | 0.70 | 25 |
| 80 | 0.09 | 10 | 522 | 0.58 | 23 |
| 81 | 0.25 | 30 | 505 | 0.55 | 30 |
| 82 | 0.40 | 60 | 444 | 0.70 | 35 |
| 83* | 0.40 | 130 | 245 | 0.78 | 47 |
| 84* | 0.60 | 120 | 303 | 1.6 | 45 |

EXAMPLE 22

The photosensitive drums 85 to 92 produced under the same conditions as those shown in Table 20 in EXAMPLE 16, excepting that the quantity of carbon in the photoconductive a-SiC layer and the P-content in the first layer zone are variously changed, were subjected to the measurements of electrophotographic characteristics with the results as shown in Table 24.

TABLE 24

| Kind of the photo-sensitive drum | Quantity of carbon as an X-value | P-content (ppm) | Charge accep-tance (V) | Record-ing ex-posure (lux · sec) | Re-sidual po-tential (V) |
|---|---|---|---|---|---|
| 85* | 0.004 | 0.3 | −437 | 0.78 | 15 |
| 86* | 0.04 | 0.3 | −452 | 0.77 | 20 |
| 87 | 0.04 | 0.8 | −475 | 0.68 | 22 |
| 88 | 0.14 | 10 | −515 | 0.55 | 19 |
| 89 | 0.28 | 40 | −500 | 0.52 | 27 |
| 90 | 0.40 | 60 | −422 | 0.68 | 33 |
| 91* | 0.40 | 140 | −230 | 0.79 | 50 |
| 92* | 0.65 | 140 | −285 | 1.3 | 47 |

It is obvious from Tables 23, 24 that the photosensitive drums 79 to 82 and 87 to 90 according to the present invention exhibit the enhanced charge acceptance, the reduced residual potential and the superior photosensitivity.

However, the photosensitive drums 77, 78, 85, 86 are inferior in photosensitivity and the photosensitive drums 83, 84, 91, 92 exhibit the reduced charge acceptance, the increased residual potential and the inferior photosensitivity.

In addition, the present inventors carried the above described photosensitive drums 61 to 65, 70 to 74, 79 to 82 and 87 to 90 on the high-speed PPC to carry out the image-taking out test at a speed of 70 pieces/min with the confirmation that the faithful reproductivity for a black color portion and a red color portion is obtained and the distinct image having no background smearing but a high concentration can be obtained.

EXAMPLE 23

The photoconductive a-Si layer (6), the first layer zone (*7a*) and the second layer zone (*7b*) were formed on the aluminum substrate in layers in this order under the film-forming conditions as shown in Tables 25, 26 by the use of the glow discharge decomposition apparatus shown in FIG. 40 to produce the photosensitive drums as shown in FIG. 2*b*.

TABLE 25

| Layer construction | Gas flow rate (sccm) $SiH_4$ | $C_2H_2$ | $H_2$ | $B_2H_6$ | $PH_3$ | Gas pressure (Torr) | High frequency electric power (W) | Film forming time (min) | Thickness (μm) |
|---|---|---|---|---|---|---|---|---|---|
| Second layer zone | 20 | 1 | 680 | — | 20 (40 ppm) | 1.20 | 150 | 5 | 0.1 |
| First layer zone | 20 | 1 | 680 | 20 (38 ppm) | — | 1.20 | 150 | 15 | 0.3 |
| Photoconductive a-Si layer | 220 | — | 250 | 1.7 (38 ppm) | — | 0.60 | 150 | 300 | 25.0 |

TABLE 26

| Layer construction | Gas flow rate (sccm) $SiH_4$ | $C_2H_2$ | $H_2$ | $PH_3$ | $B_2H_6$ | Gas pressure (Torr) | High frequency electric power (W) | Film forming time (min) | Thickness (μm) |
|---|---|---|---|---|---|---|---|---|---|
| Second layer zone | 20 | 1 | 680 | — | 20 (38 ppm) | 1.20 | 150 | 5 | 0.1 |
| First layer zone | 20 | 1 | 680 | 20 (40 ppm) | — | 1.20 | 150 | 15 | 0.3 |
| Photoconductive a-Si layer | 220 | — | 250 | — | — | 0.60 | 150 | 300 | 25.0 |

Figure 47:
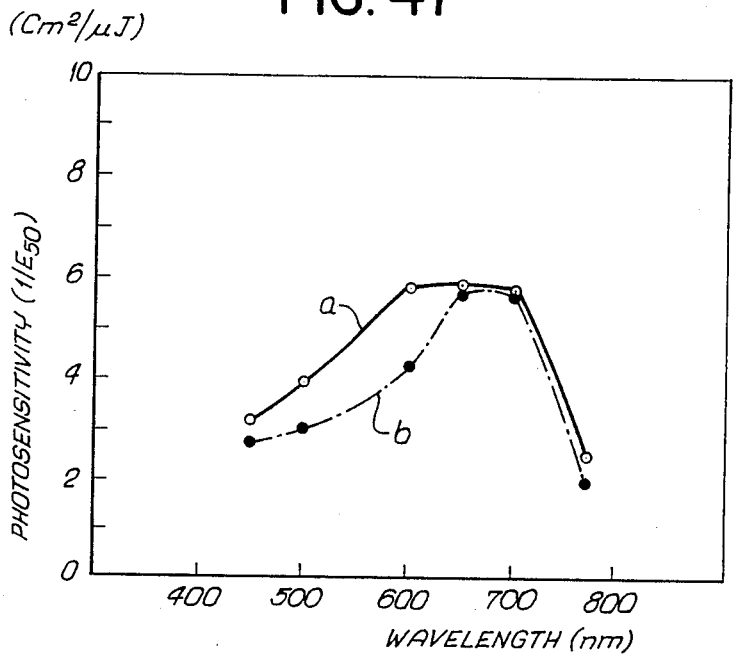
Figure 48:
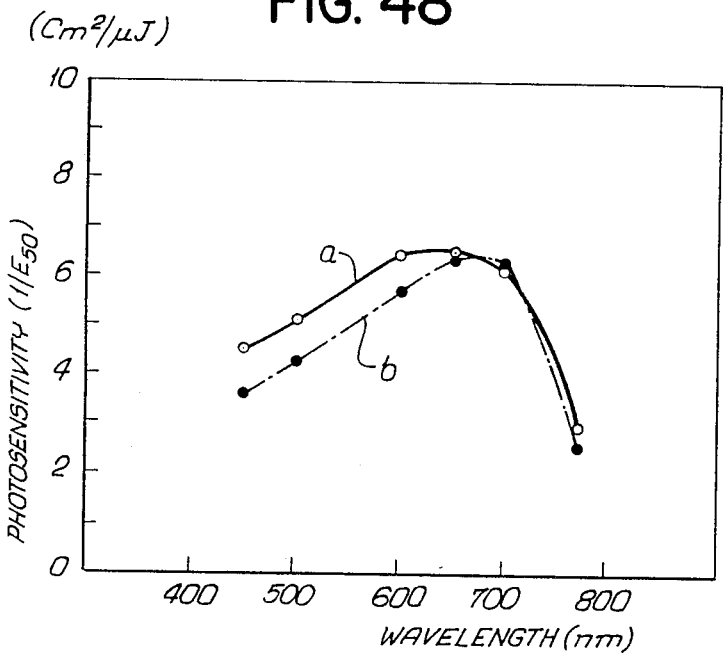

The resulting photosensitive drums were subjected to the irradiation of a monochromatic light of 0.3 $\mu W/cm^2$ spectralized by the visible light spectrometer to determine a half-life period of charge acceptance and measure the spectral sensitivity with the result shown FIG. 47 for the photosensitive drum produced under the conditions shown in Table 25 and the result shown in FIG. 48 for the photosensitive drum produced under the conditions shown in Table 26.

Referring to these drawings, an axis of abscissa shows a wavelength, an axis of ordinate showing a photosensitivity, a ○ mark showing a plot of the results of measurement, and a being a characteristic curve of the photosensitive drum.

In addition, the photosensitive drums produced by removing the second layer zone from the above described photosensitive drums are shown as COMPARATIVE EXAMPLE in FIGS. 47, 48. Their spectral sensitivity was measured with the obtainment of a plot of the results of measurement shown by a ● mark. b is a characteristic curve of the photosensitive drum.

It is obvious from these results that the photosensitive drums according to the present invention exhibit the remarkably enhanced photosensitivity on the short wavelength side.

Besides, the quantity of carbon in the above described photoconductive a-SiC layer was determined by the ESCA analysis with the result that the v-value in $Si_{(1-x)}C_x$ amounts to 0.12. Furthermore, the B-content and the P-content in the above described photoconductive a-SiC layer were determined by the secondary ion mass analyzer with the results that the B-content is 25 ppm and the P-content is 20 ppm for both the photosensitive drum produced under the conditions shown in Table 25 and the photosensitive drum produced under the conditions shown in Table 26.

EXAMPLE 24

The barrier layer (8), the photoconductive a-Si layer (6), the photoconductive a-SiC layer (7) and the surface protective layer (9) were formed on the aluminum substrate in layers in this order under the film-forming conditions as shown in the following Tables 27, 28 to produce photosensitive drums as shown in FIG. 3*b*.

TABLE 27

| Layer construction | Gas flow rate (sccm) $SiH_4$ | $C_2H_2$ | $H_2$ | $B_2H_6$ | $PH_3$ | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| Second layer zone | 20 | 1 | 680 | — | 20 (40 ppm) | — | 1.20 | 150 | 5 | 0.1 |
| First layer zone | 20 | 1 | 680 | 20 (38 ppm) | — | — | 1.20 | 150 | 15 | 0.3 |

TABLE 27-continued

| Layer construction | Gas flow rate (sccm) $SiH_4$ | $C_2H_2$ | $H_2$ | $B_2H_6$ | $PH_3$ | NO | Gas pressure (Torr) | High frequency electric power (W) | Film forming time (min) | Thickness (μm) |
|---|---|---|---|---|---|---|---|---|---|---|
| Photoconductive a-Si layer | 220 | — | 250 | 1.7 (38 ppm) | — | — | 0.60 | 150 | 300 | 25.0 |
| Carrier barrier layer | 80 | — | 280 | 60 (0.2%) | — | 2.5 | 0.45 | 75 | 90 | 3.0 |

TABLE 28

| Layer construction | Gas flow rate (sccm) $SiH_4$ | $C_2H_2$ | $H_2$ | $PH_3$ | $B_2H_6$ | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| Second layer zone | 20 | 1 | 680 | — | 20 (38 ppm) | — | 1.20 | 150 | 5 | 0.1 |
| First layer zone | 20 | 1 | 680 | 20 (40 ppm) | — | — | 1.20 | 150 | 15 | 0.3 |
| Photoconductive a-Si layer | 220 | — | 250 | — | — | — | 0.60 | 150 | 300 | 25.0 |
| Carrier barrier layer | 80 | — | 280 | 45 (0.2%) | — | 2.5 | 0.45 | 75 | 90 | 3.0 |

The resulting photosensitive drums were carried on the PPC and subjected to the irradiation of a light from a halogen lamp without using a red color-cutting filter and additionally a voltage of +5.6 KV was applied to the photosensitive drum produced under the conditions shown in Table 27 by means of a corona charger to positively charge the photosensitive drum while a voltage of −5.6 KV was applied to the photosensitive drum produced under the conditions shown in Table 28 by means of a corona charger to negatively charge the photosensitive drum followed by measuring the charge acceptance, the photosensitivity and the residual potential with the following results.

The photosensitive drum produced under the conditions shown in Table 27

| | |
|---|---|
| Charge acceptance | +544 V |
| Photosensitivity (recording exposure) | 0.59 lux · sec |
| Residual potential (a value after 5 seconds from the start of exposure) | 28 V |

The photosensitive drum produced under the conditions shown in Table 28

| | |
|---|---|
| Charge acceptance | −520 V |
| Photosensitivity (recording exposure) | 0.55 lux · sec |
| Residual potential (a value after 5 seconds from the start of exposure) | 25 V |

In addition, these photosensitive drums were carried on the high-speed PPC and carried out the image-taking out test at a speed of 70 pieces/min with the results that the faithful reproductivity for a black color portion and a red color portion is obtained and the distinct image having no background smearing but a high concentration.

EXAMPLE 25

The photosensitive drums produced by removing the second layer zone from the photosensitive drums produced under the conditions shown in Tables 27, 28 in EXAMPLE 24, other layers being formed in the same manner as shown in EXAMPLE 24, were subjected to the measurements of electrophotographic characteristics with the following results. The photosensitive drum produced under the conditions shown in Table 27

| | |
|---|---|
| Charge acceptance | +390 V |
| Photosensitivity (recording exposure) | 0.54 lux · sec |
| Residual potential (a value after 5 seconds from the start of exposure) | 20 V |

The photosensitive drum produced under the conditions shown in Table 28

| | |
|---|---|
| Charge acceptance | −380 V |
| Photosensitivity (recording exposure) | 0.52 lux · sec |
| Residual potential (a value after 5 seconds from the start of exposure) | 18 V |

As obvious from the above described results, the residual potential is reduced to some extent and also the photosensitivity is enhanced to some extent but the charge acceptance is remarkably reduced.

EXAMPLE 26

The photosensitive drums 93 to 101 produced under the same conditions as shown in Table 27 in EXAMPLE 24, excepting that the thicknesses of the first layer zone and the second layer zone are variously changed, were subjected to the measurements of electrophotographic characteristics with the results as shown in Table 29.

TABLE 29

| Kind of the photosensitive drum | Thickness of the first layer zone (μm) | Thickness of the second layer zone (μm) | Charge acceptance (V) | Recording exposure (lux · sec) | Residual potential (V) |
|---|---|---|---|---|---|
| 93* | 0.02 | 0.01 | 382 | 0.85 | 20 |
| 94* | 0.07 | 0.01 | 388 | 0.72 | 12 |
| 95 | 0.05 | 0.03 | 490 | 0.73 | 15 |
| 96 | 0.4 | 0.1 | 535 | 0.58 | 19 |
| 97 | 1.5 | 0.5 | 545 | 0.55 | 24 |
| 98 | 3.3 | 0.7 | 547 | 0.61 | 28 |
| 99 | 2.5 | 1.5 | 558 | 0.63 | 32 |
| 100* | 1.0 | 3.0 | 603 | 0.68 | 45 |
| 101* | 3.0 | 3.0 | 614 | 0.70 | 53 |

EXAMPLE 27

The photosensitive drums 102 to 110 produced under the same conditions as shown in Table 28 in EXAMPLE 24, excepting that the thicknesses of the first layer zone and the second layer zone are variously changed, were subjected to the measurements of electrophotographic characteristics with the results as shown in Table 30.

TABLE 30

| Kind of the photosensitive drum | Thickness of the first layer zone (μm) | Thickness of the second layer zone (μm) | Charge acceptance (V) | Recording exposure (lux · sec) | Residual potential (V) |
|---|---|---|---|---|---|
| 102* | 0.02 | 0.01 | −355 | 0.83 | 17 |
| 103* | 0.06 | 0.01 | −363 | 0.70 | 10 |
| 104 | 0.05 | 0.04 | −470 | 0.70 | 13 |
| 105 | 0.5 | 0.1 | −512 | 0.55 | 15 |
| 106 | 1.4 | 0.4 | −520 | 0.52 | 20 |
| 107 | 3.3 | 0.7 | −527 | 0.58 | 23 |
| 108 | 2.3 | 1.4 | −533 | 0.60 | 28 |
| 109* | 1.0 | 3.0 | −587 | 0.64 | 40 |
| 110* | 3.0 | 3.0 | −595 | 0.69 | 45 |

It is obvious from the above described Tables 29, 30 that the photosensitive drums 95 to 99 and 104 to 108 according to the present invention exhibit the enhanced charge acceptance, the reduced residual potential and the superior photosensitivity.

However, the photosensitive drums 93, 102 are inferior in charge acceptance, the photosensitive drums 94, 103 being inferior in charge acceptance, and the photosensitive drums 100, 101, 109, 110 exhibiting the increased residual potential.

EXAMPLE 28

The photosensitive drums 111 to 125 produced under the same conditions as shown in Table 27 in EXAMPLE 24, excepting that the quantity of carbon in the photoconductive a-SiC layer, the B-content in the first layer zone and the P-content in the second layer zone are variously changed were subjected to the measurements of electrophotographic characteristics with the results as shown in Table 31.

TABLE 31

| Kind of the photosensitive drum | Quantity of carbon in the a-SiC layer (x-value) | B-content in the first layer zone (ppm) | P-content in the second layer zone (ppm) | Charge acceptance (V) | Recording exposure (lux · sec) | Residual potential (V) |
|---|---|---|---|---|---|---|
| 111* | 0.005 | 10 | 4 | 475 | 0.83 | 20 |
| 112* | 0.03 | 0.3 | 4 | 492 | 0.80 | 18 |
| 113* | 0.09 | 10 | 0.2 | 295 | 0.59 | 22 |
| 114 | 0.03 | 0.6 | 4 | 499 | 0.71 | 21 |
| 115 | 0.09 | 10 | 4 | 540 | 0.60 | 24 |
| 116 | 0.09 | 10 | 0.8 | 497 | 0.58 | 19 |
| 117 | 0.09 | 10 | 60 | 552 | 0.69 | 33 |
| 118 | 0.25 | 10 | 0.8 | 482 | 0.63 | 25 |
| 119 | 0.25 | 30 | 4 | 522 | 0.55 | 28 |
| 120 | 0.25 | 30 | 40 | 533 | 0.65 | 30 |
| 121 | 0.25 | 30 | 70 | 594 | 0.69 | 32 |
| 122 | 0.40 | 60 | 4 | 478 | 0.68 | 31 |
| 123* | 0.60 | 30 | 4 | 318 | 1.5 | 48 |
| 124* | 0.40 | 120 | 4 | 273 | 0.80 | 51 |
| 125* | 0.09 | 10 | 110 | 607 | 0.88 | 53 |

EXAMPLE 29

The photosensitive drums 126 to 140 produced under the same conditions as shown in Table 28 in EXAMPLE 24, excepting that the quantity of carbon in the photoconductive a-SiC layer, the P-content in the first layer zone and the B-content in the second layer zone are variously changed, were subjected to the measurements of electrophotographic characteristics with the results as shown in Table 32.

TABLE 32

| Kind of the photosensitive drum | Quantity of carbon in the a-SiC layer (x-value) | P-content in the first layer zone (ppm) | B-content in the second layer zone (ppm) | Charge acceptance (V) | Recording exposure (lux · sec) | Residual potential (V) |
|---|---|---|---|---|---|---|
| 126* | 0.004 | 10 | 3 | −453 | 0.80 | 18 |
| 127* | 0.04 | 0.3 | 3 | −470 | 0.78 | 15 |
| 128* | 0.14 | 10 | 0.2 | −281 | 0.56 | 20 |
| 129 | 0.04 | 0.8 | 3 | −490 | 0.69 | 18 |
| 130 | 0.14 | 10 | 3 | −513 | 0.58 | 21 |
| 131 | 0.14 | 10 | 0.6 | −467 | 0.55 | 15 |
| 132 | 0.14 | 10 | 60 | −521 | 0.65 | 27 |
| 133 | 0.28 | 10 | 0.6 | −445 | 0.61 | 23 |
| 134 | 0.28 | 40 | 4 | −503 | 0.54 | 25 |
| 135 | 0.28 | 40 | 30 | −510 | 0.63 | 27 |
| 136 | 0.28 | 40 | 70 | −555 | 0.66 | 28 |
| 137 | 0.40 | 60 | 3 | −452 | 0.64 | 28 |
| 138* | 0.65 | 40 | 3 | −300 | 1.3 | 49 |
| 139* | 0.40 | 140 | 3 | −263 | 0.78 | 48 |
| 140* | 0.14 | 10 | 110 | −595 | 0.85 | 55 |

It is obvious from the above described Tables 31, 32 that the photosensitive drums 114 to 122 and 129 to 137 according to the present invention exhibit the enhanced charge acceptance, the reduced residual potential and the superior photosensitivity.

However, the photosensitive drums 111, 112, 126, 127 are inferior in photosensitivity, the photosensitive drums 113, 128 exhibiting the reduced charge acceptance, and the photosensitive drums 123 to 125 and 138 to 140 being inferior exhibiting the inferior photosensitivity and the increased residual potential. Above all, the photosensitive drums 123, 124, 138, 139 exhibit the reduced charge acceptance.

In addition, the present inventors carried the photosensitive drums 95 to 99, 104 to 108, 114 to 122 and 129 to 137 on the high-speed PPC and carried out the image-taking out test at a speed of 70 pieces/min with the confirmation that the faithful reproductivity for a black color portion and a red color portion is obtained and the distinct image having no background smearing but a high concentration can be obtained.

EFFECTS OF THE INVENTION

As above described, according to the electrophotographic sensitive member of the present invention, if the photoconductive a-Si layer and the photoconductive a-SiC layer are formed in layers and the atomic ratio of carbon, the thickness and the IIIa group element-content and/or the Va group element-content of the a-SiC layer Is set within the appointed range, respectively, the photosensitivity on both the long wavelength side and the short wavelength side can be enhanced and also the change acceptance can be enhanced. As a result, the electrophotographic sensitive member for use in PPC capable of obtaining the superior photosensitivity without using the infrared wavelength light-cutting filter is provided.

In addition, according to the electrophotographic sensitive member of the present invention, the high charge acceptance is obtained, whereby the high image concentration is obtained and additionally the freedom of designing of the development system in the copying machine can be heightened and thus, the latter can be more easily used.

We claim:

1. An electrophotographic sensitive member comprising at least a photoconductive amorphous silicon layer containing at least one of hydrogen and a halogen, and a photoconductive amorphous silicon carbide layer formed on an electrically conductive substrate in layers in this order, characterized in that an atomic ratio of a silicon element to a carbon element in said amorphous silicon carbide layer is set within a range of $0.01 \leqq x \leqq 0.5$ in a value of x in $Si_{(1-x)}C_x$ and a thickness of said amorphous silicon carbide layer is set within a range of 0.05 to 5 μm and additionally said amorphous silicon carbide layer comprises a layer zone containing elements of the group IIIa or the group Va in the periodic table therein in a quantity of 0.5 to 100 ppm, and further characterized in that the content of said elements of the group IIIa or Va in the periodic table is gradually reduced from said substrate to a surface of the photosensitive member in the direction of layer thickness.

2. An electrophotographic sensitive member comprising at least a photoconductive amorphous silicon layer containing at least one of hydrogen and a halogen, and a photoconductive amorphous silicon carbide layer formed on an electrically conductive substrate in layers in this order, characterized by that an atomic ratio of a silicon element to a carbon element in said amorphous silicon carbide layer is set within a range of $0.01 \leqq x \leqq 0.5$ in a value of x in $Si_{(1-x)}C_x$, a thickness of said amorphous silicon carbide layer being set within a range of 0.05 to 5 μm, said amorphous silicon carbide layer comprising a first layer zone containing elements of the group IIIa or Va in the periodic table in a quantity of 0.5 to 100 ppm and a second layer zone without containing the elements of the group IIIa or Va in the periodic table formed in layers in this order, and a thickness of said second layer zone being set within a range of 0.02 to 2 μm.

3. An electrophotographic sensitive member comprising at least a photoconductive amorphous silicon layer containing at least one of hydrogen and a halogen, and a photoconductive amorphous silicon carbide layer formed on an electrically conductive substrate formed in layers in this order, characterized by that an atomic ratio of a silicon element to a carbon element in said amorphous silicon carbide layer is set within a range of $0.01 \leqq x \leqq 0.5$ in a value of x in $Si_{(1-x)}C_x$, a thickness of said amorphous silicon carbide layer being set within a range of 0.05 to 5 μm, said amorphous silicon carbide layer comprising a first layer zone containing elements of the group IIIa in the periodic table in a quantity of 0.5 to 100 ppm and a second layer zone containing elements of the group Va in the periodic table in a quantity of 0.5 to 100 ppm formed in layers, and a thickness of said second layer zone being set within a range of 0.02 to 2 μm.

4. An electrophotographic sensitive member comprising at least a photoconductive silicon layer containing at least one of hydrogen and a halogen, and a photoconductive amorphous silicon carbide layer formed on an electrically conductive substrate in layers in this order, characterized by that an atomic ratio of a silicon element to a carbon element in said amorphous silicon carbide layer is set within a range of $0.01 \leqq x \leqq 0.5$ in a value of x in $Si_{(1-x)}C_x$, a thickness of said amorphous silicon carbide layer being set within a range of 0.05 to 5 μm, said amorphous silicon carbide layer comprising a first layer zone containing elements of the group Va in the periodic table in a quantity of 0.5 to 100 ppm and a second layer zone containing elements of the group IIIa in the periodic table in a quantity of 0.5 to 100 ppm formed in layers in this order, and a thickness of said second layer zone being set within a range of 0.02 to 2 μm.

* * * * *